US006089218A

United States Patent [19]

Mifune et al.

[11] Patent Number: 6,089,218

[45] Date of Patent: Jul. 18, 2000

[54] VAPORIZATION ACCELERATION DEVICE FOR HIGH-CALORIE GAS APPLIANCE

[75] Inventors: Hideo Mifune; Yasuaki Nakamura, both of Shizuoka-ken, Japan

[73] Assignee: Tokai Corporation, Shizuoka-Ken, Japan

[21] Appl. No.: 09/091,201

[22] PCT Filed: Sep. 17, 1996

[86] PCT No.: PCT/JP96/02655

§ 371 Date: Jun. 10, 1998

§ 102(e) Date: Jun. 10, 1998

[87] PCT Pub. No.: WO97/21961

PCT Pub. Date: Jun. 19, 1997

[30] Foreign Application Priority Data

Dec. 13, 1995 [JP] Japan ..... 7-324470

[51] Int. Cl.[7] ..... F24C 5/20

[52] U.S. Cl. ..... 126/38; 431/206

[58] Field of Search ..... 126/38; 431/206

[56] References Cited

FOREIGN PATENT DOCUMENTS 54-123726 9/1979 Japan .

55-25757 2/1980 Japan .

OTHER PUBLICATIONS

Japanese Utility Model Application No. 175492/1977 (Laid–Open No. 100880/1979).

*Primary Examiner*—Carroll Dority

*Attorney, Agent, or Firm*—BakerBotts, LLP

[57] ABSTRACT

In a high-calorie gas appliance (1) which is set with a replaceable fuel gas cassette (9) containing therein liquefied gas and has a burner (7) for burning vaporized fuel gas from the cassette, a heat transfer plate (15) is mounted on the gas appliance with its one end portion disposed near the burner (7) and its the other end portion in contact with the fuel gas cassette (9) so that a part of heat of combustion at the burner (7) is transferred to the fuel gas cassette (9) to heat the same. Further, a heat accumulator member (2) is disposed in contact with the heat transfer plate (15) in the position of contact of the heat transfer plate with the cassette (9). Thus temperature drop of the liquefied gas due to vaporization latent heat in response to gas supply from the cassette is suppressed, thereby ensuring stable gas supply even if the amount of gas in the cassette upon initiation burning is reduced and ensuring exhaustion of the cassette upon quenching.

18 Claims, 27 Drawing Sheets

VAPORIZATION ACCELERATION DEVICE FOR HIGH-CALORIE GAS APPLIANCE

FIELD OF THE INVENTION

This invention relates to a vaporization acceleration device for a high-calorie gas appliance to which a fuel gas cassette containing therein liquefied fuel gas such as normal butane or isobutane can be set, and more particularly to such a vaporization acceleration device which makes it feasible to continuously supply the fuel gas from the cassette to the gas appliance so that stable calorie can be obtained and to exhaust the fuel gas cassette without any residual gas.

There have been in wide use various gas appliances employing the fuel gas cassette such as a portable cooking stove. Such a cassette type cooking stove is required to be large in heat capacity and it is further preferred that the fuel gas cassette can be exhausted for an economic reason and the like. When these requirements are met, the cassette type gas appliances will be used wider coupled with their convenience. This invention is directed to these situations.

BACKGROUND

In a cassette type gas appliance such as a cassette type cooking gas stove, a cassette type gas stove or the like, the fuel gas can be successively supplied from the fuel gas cassette to the burner without any problem at normal temperatures and the fuel gas in the cassette can be easily exhausted so long as the gas appliance is of a low-calorie type which is lower than 1800 kcal/hr in caloric force.

On the other hand, in the case of a high-calorie gas appliance where the caloric force is not lower than 1800 kcal/hr, the amount of vaporizing liquefied gas in the cassette increases with increase in gas supply to the burner. As the amount of vaporizing liquefied gas in the cassette increases, vaporization latent heat increase and when the vaporization latent heat exceeds the heat capacity of the cassette casing and the liquefied gas therein and the quantity of heat from surroundings, the temperature of the liquefied gas in the cassette lowers, which lowers the equilibrium gas pressure. When the equilibrium gas pressure lowers, a required amount of vaporized gas cannot be supplied to the burner from the cassette, which lowers the caloric force at the burner to make trouble in use of the gas appliance and makes it difficult to exhaust the cassette of the liquefied gas therein.

That is, when the caloric force is weakened in response to reduction in gas supply due to temperature drop of the fuel gas cassette, the user will consider the cassette to be exhausted and attempt to replace the fuel gas cassette. However when the user shakes the removed cassette, he or she will know that there remains some liquefied gas in the cassette. When the temperature of the cassette is elevated to the room temperature, gas supply becomes feasible again but the temperature of the cassette will drop soon to cause a shortage of fuel supply. Thus it is troublesome to exhaust the cassette of liquefied gas. Further the fact that good combustion cannot be obtained though there remains liquefied gas in the cassette causes the gas appliance and/or the fuel gas cassette to seem defective and damages reliability of the products.

Thus it is most preferred that the gas appliance burns at a predetermined high-calorie so long as there remains any amount of liquefied gas in the cassette and is quenched with its caloric force abruptly weakened when the cassette is exhausted.

As disclosed, for instance, in Japanese Unexamined Patent Publication No. 55(1980)-25757, there has been known a structure in which the fuel gas cassette is heated by heat of the burner through a heat transfer plate. That is, in the structure, the heat transfer plate is disposed with its one part positioned near the burner and its another part in contact with a fuel gas cassette set to the gas appliance so that heat of the burner is transferred to the cassette to suppress temperature drop of the liquefied gas in the cassette due to vaporization latent heat, thereby accelerating vaporization of the liquefied gas to ensure sufficient gas supply to the burner and to ensure exhaustion of the cassette.

However this approach is disadvantageous in that it is difficult to design the heat transfer plate from the viewpoint of how much heat should be transferred to the cassette. When the gas appliance is used in an elevated temperature area in summer, heat supply to the cassette from the air increases and at the same time heat dissipation during heat transfer through the heat transfer plate reduces. Accordingly when the heat transfer through the heat transfer plate is large, the cassette can be overheated and the internal pressure of the cassette can become abnormally high. Accordingly the heat transfer plate should be designed so that the cassette cannot be overheated even under such a high temperature condition.

On the other hand, when the gas appliance provided with a heat transfer plate designed to meet the above requirements is used under a low temperature condition in winter, heat supply to the cassette through the heat transfer plate becomes insufficient and gas supply to the burner becomes insufficient due to temperature drop of the cassette caused by the latent heat upon vaporization of the liquefied gas, which results in poor caloric force at the burner. Further when the amount of liquefied gas remaining in the cassette is small, heat capacity of the liquefied gas in the cassette becomes smaller. That is, the smaller the amount of liquefied gas remaining in the cassette is, the larger the temperature drop is.

As can be seen from the description above, the approach where a part of heat of combustion at the burner is transferred to the cassette through a heat transfer plate to suppress temperature drop of the cassette can accomplish the object only under a particular condition (which will be described with reference to FIGS. 14 to 16 later). That is, little heat is supplied to the cassette through the heat transfer plate for a predetermined time after initiation of combustion, and heat supply to the cassette through the heat transfer plate is not stabilized until a predetermined time (e.g., 5 to 7 minutes) elapses. In normal use of a gas appliance, the time for which a high-calorie is required is often shorter than such an initial time and accordingly if the amount of liquefied gas remaining in the cassette is small, an abrupt temperature drop occurs, which results in shortage in caloric force and difficulties in exhausting the cassette of liquefied gas.

Another approach to prevent temperature drop of the liquefied gas in response to gas supply to the burner due to vaporization latent heat involves, as disclosed for instance in Japanese Unexamined Patent Publication No. 54(1979)-123726, use of vaporization accelerating material in the form of latent heat material disposed inside or on the cassette. The latent heat material generates heat of solidification which is supplied to the cassette to suppress temperature drop of the cassette.

This approach gives rise to problem that it is difficult to supply heat from the latent heat material stably for a long time. That is, in the case of a gas appliance where the caloric force is high and gas consumption is large, cooling rate of the liquefied gas due to the vaporization latent heat is large since the amount of vaporization is large. Accordingly even if heat supply from the latent heat material through the cassette wall is initially sufficient, heat inside the latent heat material is not sufficiently transferred outward through the area of contact if heat transfer and convection inside the latent heat material are not sufficient, which can result in shortage of heat transferred to the cassette and temperature drop of the cassette though the heat capacity of the overall latent heat material is sufficient. Thus vaporization accelerating effect cannot be obtained satisfactorily. Especially when the gas appliance is used with a small amount of liquefied gas remaining in the cassette, the temperature drop is sharp and the above phenomenon is remarkable.

Another approach of heating the fuel gas cassette involves use of a heat transfer plate which is in contact with the cassette and supplies heat obtained by heat exchange from the surrounding air to the cassette, thereby suppressing temperature drop of the cassette as disclosed, for instance, in Japanese Unexamined Patent Publication No. 54(1979)-100880.

In this approach, the quantity of heat supplied to the cassette through the heat transfer plate greatly depends upon the environmental temperature and there is a problem in supplying a stable quantity of heat for a long time.

As described above, in the approach where heat of combustion at the burner is supplied to the gas cassette through a heat transfer plate, the quantity of heat to be supplied should be limited not to bring the cassette into an overheated state even under a high temperature condition of use. Accordingly, it takes 6 to 7 minutes for the temperatures of the parts of the heat transfer plate to attain equilibrium after ignition of the burner, and during this period, heat supply to the cassette through the heat transfer plate is insufficient (See FIG. 20). In the approach where the cassette is heated by use of a latent heat material, it has been found that though a sufficient quantity of heat can be initially supplied to the cassette through supply of sensible heat and latent heat of fusion of the latent heat material, heat transfer from the inside of the latent heat material is reduced after long use and the temperature of the cassette tends to drop. (This will be described later with reference to FIGS. 14 to 16) It is considered that the heat transfer plate for heat exchange has the similar tendency.

When a fuel gas cassette is set to a gas appliance and the gas appliance starts burning at a high calorie (e.g., 2500 kcal/hr), the temperature of the cassette drops and the caloric force lowers as time lapses. In order to maintain a desired caloric force, the cassette should be kept at not lower than 6° C. at the lowest, and preferably not lower than 8° C. Though substantially the same cassette temperature is required irrespective of the desired caloric force, a lower caloric force can be maintained even if the cassette temperature is somewhat lower. Thus, in order to keep the current fuel gas of butane burning rate high, the temperature of the cassette must be kept not lower than the above values.

In view of the foregoing observations and description, the primary object of the present invention is to provide a vaporization acceleration device for a high-calorie gas appliance which can supply proper amount of heat to the cassette and suppress temperature drop of the cassette irrespective of temperature of the atmosphere of use and irrespective of whether the fuel gas start burning or has been burning a long time, thereby accelerating vaporization of the liquefied gas so that the caloric force can be maintained high and the cassette can be exhausted of liquefied gas therein. The vaporization acceleration device of the present invention has been made on the basis of heat supply properties of a heat transfer plate which transfers a part of combustion heat to the cassette and a heat accumulator or heat exchanger member which is in contact with the cassette and selectively supplies heat according to the temperature difference.

DISCLOSURE OF THE INVENTION

In accordance with a first aspect of the present invention, there is provided a vaporization acceleration device for a high-calorie gas appliance which is set with a replaceable fuel gas cassette containing therein liquefied gas and has a burner for burning vaporized fuel gas from the cassette, which vaporization acceleration device comprising a heat transfer plate which is mounted on the gas appliance with its one end portion disposed near the burner and its the other end portion in contact with the fuel gas cassette so that a part of heat of combustion at the burner is transferred to the fuel gas cassette to heat the same, and a heat accumulator member which is disposed in the position of contact of the heat transfer plate with the cassette, the heat accumulator member being in contact with the heat transfer plate or being in contact with the heat transfer plate and at the same time being adapted to be brought into contact with the cassette.

It is preferred that a heat conductive member be provided in contact with the heat transfer plate and a part of the heat accumulator member other than the part in contact with the heat transfer plate.

The heat accumulator member may comprise, for instance, a liquid heat accumulator material contained in a casing or a solid heat accumulator material. The liquid heat accumulator material may be a latent heat accumulator material which is 4 to 14° in fusion point or water. In the former case, latent heat of fusion of the material is utilized and the latter case, sensible heat of water is utilized. In the case of a solid heat accumulator material, sensible heat of the material is utilized.

The reason why the fusion point of the latent heat accumulator material is 4 to 14° is to maintain the temperature of the fuel gas cassette and the liquefied gas therein, thereby maintaining caloric force of the gas appliance. It is necessary to select the fusion point of the latent heat accumulator material according to the caloric force of the gas appliance. Supercooling can occur when the latent heat accumulator material cools, and accordingly it is necessary to select a latent heat accumulator material whose fusion point is higher than required. For example, it is practical to use a latent heat accumulator material whose fusion point is 4° C. at the lowest for a gas appliance which is 1800 kcal/hr in caloric force and in which the cassette or the liquefied gas therein is required to be kept at a temperature from 3 to 6° C. For a gas appliance which is 2200 kcal/hr in caloric force and in which the cassette or the liquefied gas therein is required to be kept at a temperature from 4 to 6° C., it is practical to use a latent heat accumulator material whose fusion point is 6° C. at the lowest, and for a gas appliance which is 2500 kcal/hr in caloric force and in which the cassette or the liquefied gas therein is required to be kept at a temperature from 6 to 8° C., it is practical to use a latent heat accumulator material whose fusion point is 8° C. at the lowest. The higher side of the fusion point for the latent heat accumulator material may be about 14° C.

When polyethylene glycol is employed as the latent heat accumulator material, it is preferred that polyethylene glycols of different molar weights are mixed to adjust the fusion point of the latent heat accumulator material.

The heat accumulator material whose latent heat is utilized is a material which releases heat in response to first-order transition such as solidification in its temperature range of use without change in temperature. The heat accumulator material whose sensible heat is utilized is a material which releases heat in response to temperature range without involving change in physical state like solidification.

The heat accumulator material whose latent heat is utilized includes sodium sulfate decahydrate as an inorganic salt in addition to polyethylene glycol. Sodium tetraborate decahydrate is added to sodium sulfate decahydrate as an anti-supercooling agent and sodium chloride as a fusion point control agent. For example, in a salt comprising 78% of $Na_2SO_4 \cdot 10H_2O$, 20% of NaCl, and 2% of $Na_2B_4O_7 \cdot 10H_2O$, the fusion point is 13° C.

In accordance with a second aspect of the present invention, there is provided a vaporization acceleration device comprising a heat transfer plate which is mounted on the gas appliance with its one end portion disposed near the burner and its the other end portion in contact with the fuel gas cassette so that a part of heat of combustion at the burner is transferred to the fuel gas cassette to heat the same, and a heat exchanger member which exchanges heat with the air and is disposed in contact with the heat transfer plate in the position of contact of the heat transfer plate with the cassette.

The heat exchanger member may be disposed in contact with the heat transfer plate in the position of contact of the heat transfer plate with the cassette and at the same time to be able to be brought into contact with a part of the cassette. The heat exchanger member may be a member which is formed by folding a metal plate or a metal foil and fixed to the heat transfer plate on the side opposite to the side which the cassette is in contact with, or may be a member of a honeycomb sandwich structure, or may be a member having fin-like projections.

In accordance with a third aspect of the present invention, there is provided a vaporization acceleration device comprising a heat exchanger member which exchanges heat with the air and is disposed to be able to be brought into contact with the cassette, and a heat transfer plate which is mounted on the gas appliance with its one end portion disposed near the burner and its the other end portion in contact with the heat exchanger member so that a part of heat of combustion at the burner is transferred to the heat exchanger member.

In the vaporization acceleration device provided with said heat transfer plate and the heat accumulator member, when vaporized fuel gas is supplied to the gas appliance in response to its combustion at high calorie, the temperature drop occurs in the liquefied gas due to heat absorption by vaporization latent heat. At the beginning of combustion, heat supply through the heat transfer plate is small and heat is supplied to the cassette from the heat accumulator member according to temperature difference between the heat accumulator member and the cassette since the temperature of the cassette becomes lower than that of the heat accumulator member, whereby temperature drop of the cassette is suppressed to accelerate vaporization of the liquefied gas and the caloric force of the gas appliance can be prevented from lowering. If the vaporization acceleration device is further provided with a heat conductive member, heat is supplied to the cassette from the heat accumulator member also through the heat conductive member and accordingly the quantity of heat supplied and the heat supply rate are increased, whereby vaporization acceleration can be effected for a combustion at higher calorie and/or combustion with a smaller amount of remaining liquefied gas.

In the vaporization acceleration device provided with the heat transfer plate and the heat exchanger member, heat supply through the heat transfer plate is also small at the beginning of combustion, and at this time heat absorbed from the air by heat exchange is supplied from the heat exchanger member to the cassette, whereby temperature drop of the cassette is suppressed to accelerate vaporization of the liquefied gas and the caloric force of the gas appliance can be prevented from lowering. In the heat supply by the heat exchanger member, heat is quickly transferred to the cassette according to the temperature difference between the air and the cassette and at the same time when the temperature difference is reduced, the quantity of heat transferred to the cassette is also reduced, whereby heat is not supplied more than necessary. Especially when the heat exchanger member is formed of a high thermal conductive material in a large surface area structure so that heat exchange performance is increased, heat supply rate is further increased to be able to respond to vaporization latent heat speed for combustion at a high calorie, whereby vaporization acceleration can be sufficient for a combustion at higher calorie and/or combustion with a smaller amount of remaining liquefied gas.

When the gas appliance continues burning for a certain time period, a predetermined quantity of heat is supplied through the heat transfer plate to heat the cassette, and at the same time, heat is supplied to the cassette from the surroundings, the heat accumulator member and the heat exchanger member. Such heat supply and vaporization latent heat attain equilibrium in time and vaporized fuel gas supply is stabilized and combustion at a predetermined caloric force can be maintained. Especially when combustion is kept continuing, the quantity of heat supplied through the heat transfer plate becomes substantially constant, and stable equilibrium state is maintained and the cassette can be exhausted of liquefied gas when the gas appliance is quenched.

When a latent heat accumulator material is used in the heat accumulator member, the latent heat accumulator material is initially in liquid state and the temperature of the material lowers according to the specific heat and the amount of the material due to heat absorption by the vaporization latent heat of the liquefied gas. When the temperature of the latent heat accumulator material drops to its fusing point, the material begins to solidify and release heat of solidification. The heat of solidification continues to be released without change in temperature until the entire latent heat accumulator member solidifies.

When the environmental temperature increases, heat supply from the surroundings increases and heat dissipation from the heat transfer plate is reduced, which results in larger heat supply to the cassette. However since the end portion of the heat transfer plate is in contact with both the cassette and the heat accumulator member or the heat exchanger member, a part of the heat transferred through the heat transfer plate is absorbed by the heat accumulator member or released to the air through the heat exchanger member, whereby overheating of the cassette can be prevented.

In accordance with a fourth aspect of the present invention, there is provided a vaporization acceleration device for a high-calorie gas appliance which is set with a replaceable fuel gas cassette containing therein liquefied gas and has a burner for burning vaporized fuel gas from the cassette, which vaporization acceleration device comprising a heat accumulator member of metal a part of which is in contact with the cassette so that heat is supplied to the cassette from the heat accumulator member in early stages of combustion, and a heat transfer plate which is disposed with its one end portion disposed near the burner and its the other end portion in contact with the heat accumulator member and not in contact with the cassette so that a part of heat of combustion at the burner is transferred to the heat accumulator member.

In accordance with a fifth aspect of the present invention, there is provided a vaporization acceleration device for a high-calorie gas appliance which is set with a replaceable fuel gas cassette containing therein liquefied gas and has a burner for burning vaporized fuel gas from the cassette, which vaporization acceleration device comprising a heat accumulator member of metal a part of which is in contact with the cassette so that heat is supplied to the cassette from the heat accumulator member in early stages of combustion, and a heat transfer plate which is disposed with its one end portion disposed near the burner and its the other end portion not in contact with the heat accumulator member and in contact with the cassette at a portion not in contact with the heat accumulator member so that a part of heat of combustion at the burner is transferred to the cassette.

When the surface of the heat accumulator member to be in contact with the cassette is formed into an arcuate surface conforming to the surface of the barrel of the cassette and a vertical slot is formed in the arcuate surface so that the welded portion of the barrel which is in the form of a protrusion extending in the longitudinal direction of the barrel is received in the vertical slot, the wall surface of the barrel of the cassette can contact with the heat accumulator member in a larger area, whereby heat transfer efficiency from the heat accumulator member to the cassette can be increased and an expected vaporization acceleration effect can be obtained.

Similarly when the heat accumulator member is formed of a flexible container and metal particles or metal powder contained in the container, and the surface of the container to be in contact with the cassette is formed into an arcuate surface conforming to the surface of the barrel of the cassette, and the heat accumulator member is brought into contact with the barrel of the cassette in an area including the welded portion of the barrel, close contact between the heat accumulator member and the cassette can be obtained and a sufficient vaporization acceleration effect can be obtained.

In the vaporization acceleration device provided with such a metal heat accumulator member and a heat transfer plate, temperature drop of the cassette can be suppressed and vaporization can be accelerated by heat supply through the heat transfer plate after elapse of 6 to 7 minutes after ignition. However in early stages of combustion at the burner therebefore, temperature drop of the cassette is suppressed and vaporization is accelerated by heat supply from the heat accumulator member in contact with the cassette according to temperature difference therebetween. In this case, quick heat supply from the heat accumulator member corresponding to cooling rate of the cassette is important as well as a large heat accumulation in the heat accumulator member. In this regard, by forming the heat accumulator member of metal which is high in thermal conductivity, heat can be quickly transferred from the heat accumulator member including the inside thereof in response to temperature drop of the cassette, whereby temperature drop of the cassette can be effectively suppressed until heat supply through the heat transfer plate becomes sufficient.

In the case of the vaporization acceleration device in which the heat transfer plate is not in contact with both the cassette and the heat accumulator member, a part of heat of combustion at the burner is directly transferred only to the cassette or transferred to the cassette through the heat accumulator member. Accordingly, probability that the heat to be supplied to the cassette is transferred to the heat accumulator member and released to the air through the outer surface of the heat accumulator member can be reduced, whereby heat of combustion at the burner can be effectively used for heating the cassette and effective vaporization acceleration can be ensured.

Further generally a welded portion projects from the outer surface of the barrel of the cassette and accordingly when the contact area between the heat accumulator member and the barrel of the cassette is reduced by the welded portion, heat supply from the heat accumulator member is reduced and sufficient vaporization acceleration effect cannot be obtained. BY forming the contact surface of the heat accumulator member to receive the welded portion of the barrel, a large contact area can be ensured and deterioration of heat transfer efficiency can be prevented.

Thus in accordance with the present invention, heat is supplied to the cassette from the heat accumulator member or the heat exchanger member to suppress temperature drop of the cassette in early stages of combustion where heat supply through the heat transfer plate is insufficient, and heat is thereafter supplied through the heat transfer plate, whereby vaporization acceleration is effectively obtained so that high-calorie combustion can be maintained even if the amount of remaining liquefied gas in the cassette is reduced and the cassette can be exhausted of liquefied gas when it is to be replaced.

BEST MODE OF EMBODYING THE INVENTION

Gas appliances provided with vaporization acceleration devices in accordance with respective embodiments of the present invention and experiments for proving the effects of the respective embodiments will be described with reference to the drawings, hereinbelow.

[First embodiment]

Figure 1:
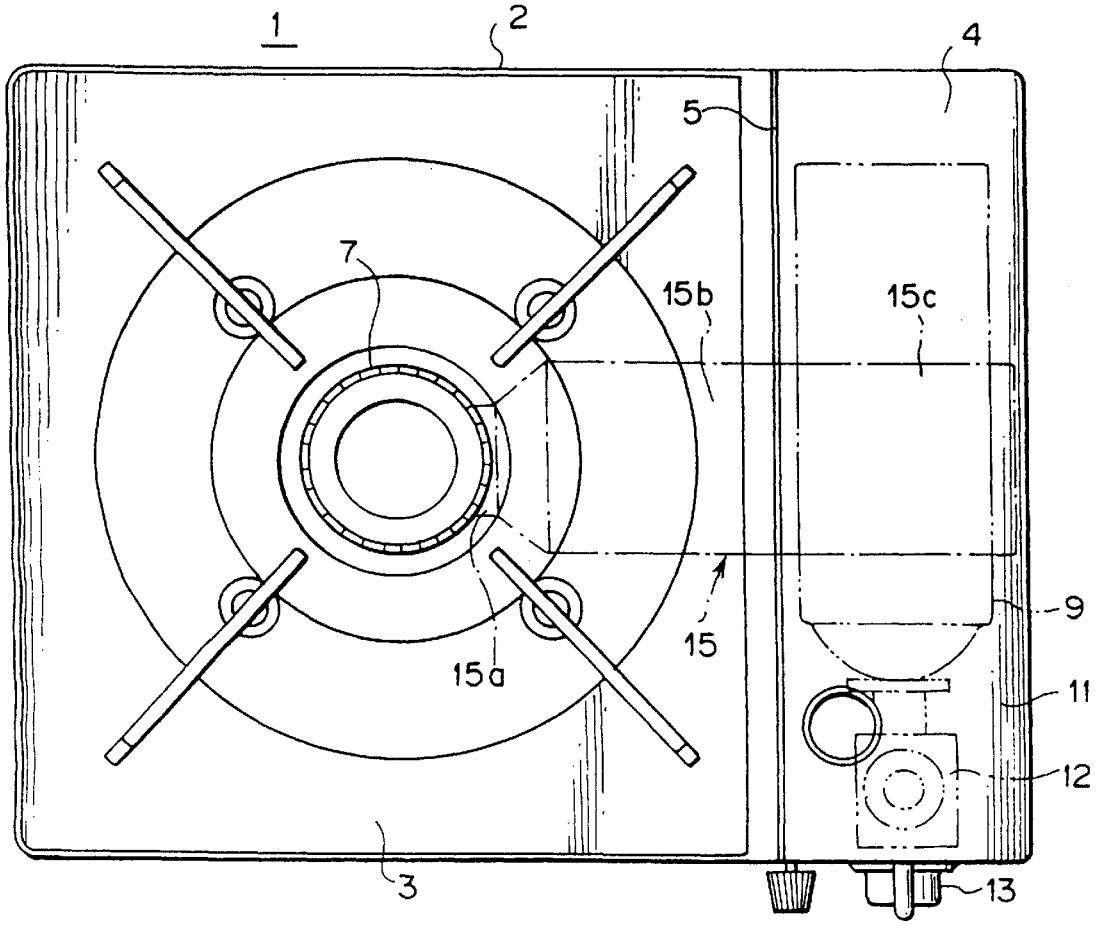
FIG. 1 is a plan view of a gas appliance provided with a vaporization acceleration device in accordance with a first embodiment of the present invention.
Figure 2:
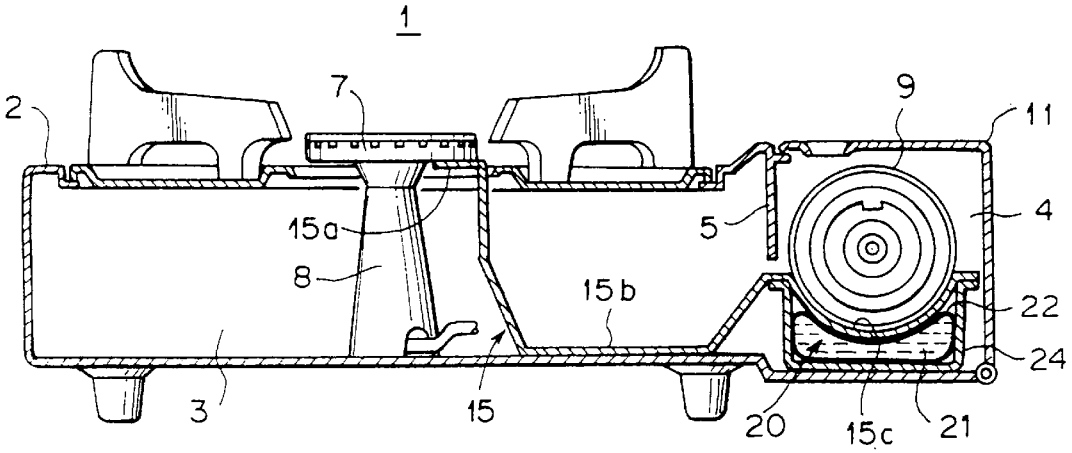
FIG. 2 is a schematic cross-sectional view of the gas appliance shown in FIG. 1.
Figure 3:
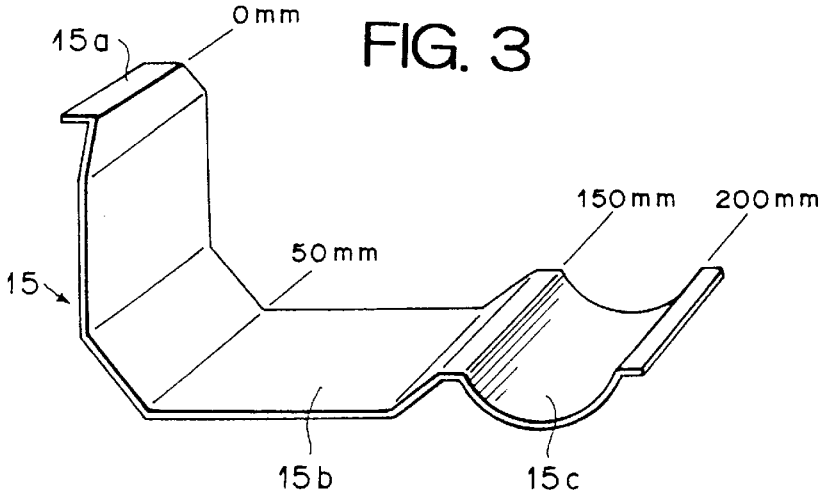
FIG. 3 is a perspective view of the heat transfer plate shown in FIG. 1.

FIG. 1 is a plan view showing a gas appliance provided with a vaporization acceleration device in accordance with a first embodiment of the present invention, FIG. 2 is a cross-sectional view of the gas appliance, and FIG. 3 is a perpsective view of the heat transfer plate.

A gas appliance 1 (a handy cooking stove) comprises a body portion 2. The body portion 2 is parted into a combustion portion 3 and a cassette receiving portion 4 by a partition plate 5. A burner 7 for burning fuel gas is disposed at the center of the combustion portion 3 and is fixed to the bottom of the body portion 2 by a mixing pipe 8. The cassette receiving portion 4 in which a fuel gas cassette 9 is set is provided with an openable cover 11. A governor 12 is installed in the cassette receiving portion 4 at one end thereof. The governor 12 is associated with the gas supply portion of the cassette 9 when the cassette 9 is set in place to push the stem and to receive vaporized gas discharged from the cassette 9. The governor 12 regulates the pressure of the vaporized gas to a predetermined pressure and feeds the regulated gas to the mixing pipe 8 at a flow rate according to the opening of a cock 13. The gas is mixed with air in the mixing pipe 8 and discharged from the burner 7.

The gas appliance 1 is provided with a vaporization acceleration device in accordance with a first embodiment of the present invention. The vaporization acceleration device comprises a heat transfer plate 15 shown in FIG. 3. The heat transfer plate 15 is formed of a plate of a high thermal conductive material such as aluminum. The heat transfer plate 15 is for connecting the burner 7 and the cassette receiving portion 4. The heat transfer plate 15 comprises a flat intermediate portion 15*b* which extends along the bottom of the body portion 2. An end portion is erected from the intermediate portion 15*b* upward near the burner 7 and is bent horizontally to form a heat receiving portion 15*a*, which is fixed to the bottom of the burner 7. The heat receiving portion 15*a* is in contact with a part of the burner 7 and receives a part of heat of combustion at the burner. The heat received by the heat receiving portion 15*a* is transferred through the heat transfer plate 15 and is transferred to the cassette 9 by way of a heat releasing portion 15*c* at the other end of the heat transfer plate 15 in contact with the cassette 9. The heat releasing portion 15*c* is in the form of a channel which extends along the cylindrical peripheral surface of the cassette 9. The heat releasing portion 15*c* is connected to the intermediate portion 15*b* by way of a connecting portion which erects upward from the intermediate portion 15*b* and extends below the partition plate 5 into the cassette receiving portion 4. The fuel gas cassette 9 is placed on the heat releasing portion 15*c* so that the peripheral surface thereof is brought into a direct contact with the heat releasing portion 15*c*, whereby heat from the burner 7 is transferred to the liquefied gas in the cassette 9 through the wall of the cassette 9.

In this particular embodiment, the heat transfer plate 15 is formed of a pure aluminum plate which is 0.8 mm in thickness, 80 mm in width and 205 mm in length. When fuel gas burns at the burner 7 and the temperature of the burner 7 itself is elevated, the heat receiving portion 15*a* of the heat transfer plate 15 is heated and the heat of the heat receiving portion 15*a* is transferred through the heat transfer plate 15 toward the other end to heat the heat releasing portion 15*c*, whereby the cassette 9 is heated.

Figure 21:
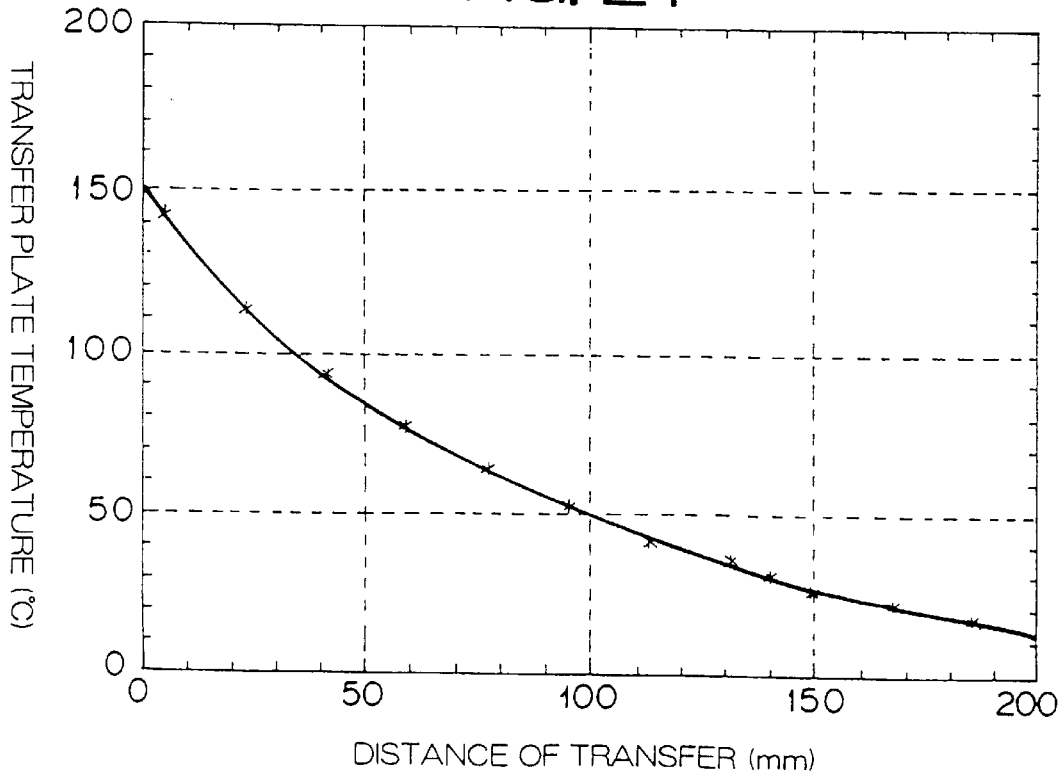
FIG. 21 is a graph showing a result of measurement of temperatures of various parts of the heat transfer plate in the third experiment.

Dimensions in FIG. 3 denote distances from the heat receiving portion 15*a* by which heat is transferred in measurement which will be described later with reference to FIGS. 21 and 22.

A heat accumulator member 20 is disposed under the heat releasing portion 15*c* of the heat transfer plate 15 at the bottom of the cassette receiving portion 4 and a heat conductive plate 24 is disposed under the heat accumulator member 20. The heat accumulator member 20 comprises a liquid heat accumulator material 21 contained in a container 22 formed of a wrapping material. The liquid heat accumulator material 21 is a latent heat accumulator material comprising a 6:4 mixture of polyethylene glycol #400 and polyethylene glycol #600 which are 4 to 8° C. and 15 to 25° C. in solidification point range, the fusing point of the mixture being about 10° C.

By changing the proportions of the components, the properties of heat of solidification can be set as required, and by selecting the components, latent heat accumulator materials of different properties can be obtained.

Specifically the heat accumulator member 20 may comprise 100 mL of the liquid heat accumulator material 21 enclosed in the container 22 in the form of a bag 70 mm wide and 130 mm long formed of soft vinyl chloride film. The heat accumulator member 20 is in contact with the lower surface of the heat releasing portion 15*c* of the heat transfer plate 15 and is in a direct contact with the cassette 9 on the rear and front sides of the heat transfer plate 15. In order to make excellent heat transfer between the heat accumulator member 20 and the heat transfer plate 15, the lower surface of the heat accumulator member 20 and a part of the heat transfer plate 15 are covered with a heat conductive member 24 of aluminum foil which is 50 $\mu$m in thickness, 80 mm in width and 100 mm in length.

With the arrangement of this embodiment, when the cassette 9 is set in the cassette receiving portion 4 and high-calorie burning is initiated at the burner 7, the temperature of liquefied gas in the cassette 9 lowers due to vaporization latent heat absorbed upon vaporization of the liquefied gas in response to gas supply from the cassette 9. However heat is supplied from the heat accumulator material 21 according to the temperature difference between the cassette 9 and the heat accumulator member 20. When the temperature of the heat accumulator material lowers to the solidification point of the material, the material 21 releases latent heat of fusion and supplies it to the cassette 9. Heat is transferred from the heat accumulator member 20 to the cassette 9 also through the heat conductive member 24 from the lower side of the heat accumulator member 20, which increases the rate of heat supply.

As the temperature of the burner 7 increases due to burning at the burner 7, a part of heat of combustion is transferred through the heat transfer plate 15 and is supplied to the cassette 9 from the heat releasing portion 15*c*, which contributes in suppressing temperature drop of the liquefied gas. In the early stages of burning, heat is supplied mainly from the heat accumulator member 20 and after a certain time (6 to 7 minutes) elapses after ignition, heat is supplied through the heat transfer plate 15.

When the environmental temperature increases, the heat transferred through the heat transfer plate 15 is supplied not only to the cassette 9 but also to the heat accumulator member 20 in contact with the cassette 9, thereby suppressing the cassette 9 from being overheated.

When heat supply from the heat transfer plate 15 and the heat accumulator member 20 and heat absorption due to vaporization latent heat attain equilibrium, the cassette 9 is kept at a certain constant temperature and the gas pressure in the cassette 9 is held at a vapor pressure corresponding to the temperature, whereby a stable amount of gas supply is obtained and rapid drop in gas pressure and gas supply can be prevented, thereby preventing lowering in caloric force.

Using the gas appliance 1 with the arrangement described above, a cassette 9 containing therein liquefied butane gas (70% of normal butane and 30% of isobutane) was set to the gas appliance 1 and change in caloric force until the liquefied gas was exhausted and the gas appliance 1 was spontaneously quenched was measured with the caloric force initially set at 2200 kcal/hr. The result of the burning experiment (experiment 1 which will be described later) is shown by chained line A in FIGS. 14 to 16.

As the liquid heat accumulator material 21 of the heat accumulator member 20, in addition to a latent heat accumulator material such as polyethylene glycol or sodium sulfate decahydrate, a sensible heat accumulator material such as water, oil or the like enclosed in the container 22 may also be used. (The result of burning experiment using water as the heat accumulator material is shown by chained line C in FIGS. 14 to 16.) Further a solid sensible heat accumulator material such as brick, concrete, clay, plastic or the like may be used. (The result of burning experiment using paper clay as the heat accumulator material is shown by dashed line B in FIGS. 14 to 16.) The kinds of the heat accumulator material which may be employed can be applied to second and third embodiments to be described later.

[Second embodiment]

Figure 4:
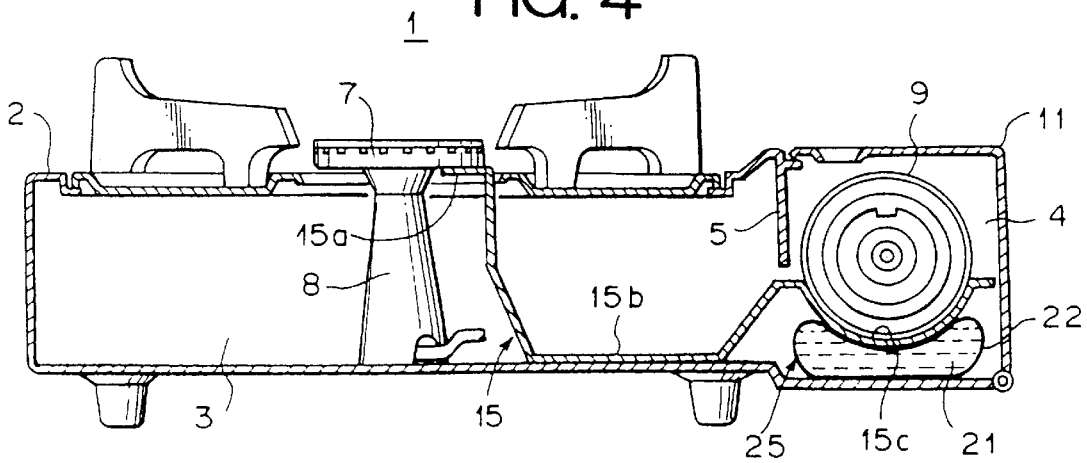
FIG. 4 is a schematic cross-sectional view of a gas appliance provided with a vaporization acceleration device in accordance with a second embodiment of the present invention.

The vaporization acceleration device of this embodiment is shown in FIG. 4 and is provided with the same heat transfer plate as in the first embodiment but with a heat accumulator member different from that of the first embodiment.

The heat transfer plate 15 is the same in the shape as that in the first embodiment and transfers a part of heat of combustion at the burner 7 to the cassette 9. A heat accumulator member 25 is also similar to that of the first embodiment and comprises a liquid heat accumulator material 21 of polyethylene glycol enclosed in a container 22 in the form of a bag of a wrapping material. The heat accumulator member 25 is disposed in the cassette receiving portion 4 in contact with the lower surface of the heat releasing portion 15*c* of the heat transfer plate 15 and in a direct contact with the cassette 9 on the rear and front sides of the heat transfer plate 15. The elements analogous to those in the first embodiment are given the same reference numerals and will not be described here.

This embodiment differs from the first embodiment in that there is no heat conductive member 24 of aluminum foil and heat transfer between the heat accumulator member 25 and the heat transfer plate 15 occurs only through the contact surfaces thereof. Also in this embodiment, vaporization acceleration effect equivalent to that of the first embodiment can be obtained for continuous burning at the burner 7 at a caloric force of 2200 kcal/hr in a normal environment of use.

[Third embodiment]

Figure 5:
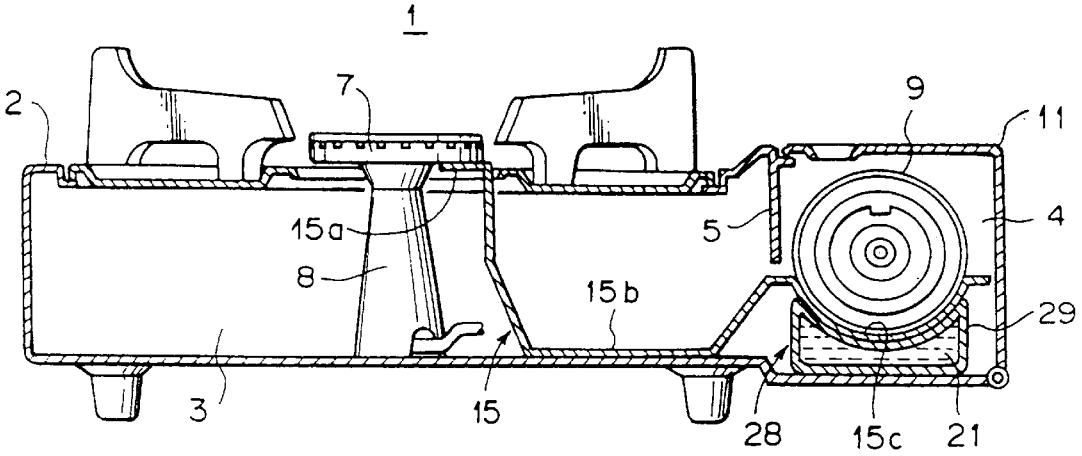
FIG. 5 is a schematic cross-sectional view of a gas appliance provided with a vaporization acceleration device in accordance with a third embodiment of the present invention.

The vaporization acceleration device of this embodiment is shown in FIG. 5 and is provided with the same heat transfer plate as in the first embodiment but with a heat accumulator member different from that of the first embodiment.

In this embodiment, the heat accumulator member 28 comprises a liquid heat accumulator material 21 enclosed in a metal container 29. The metal container 29 is formed, for instance, of aluminum and is in the form of a channel conforming to the cylindrical peripheral surface of the cassette 9. The portion of the heat accumulator member 28 opposed to the heat releasing portion 15*c* of the heat transfer plate 15 is in a close contact with the lower surface of the heat releasing portion 15*c*. Except for this fact, the vaporization acceleration device of this embodiment is the same as that of the first embodiment.

In this embodiment, since the container 29 of the heat accumulator member 28 is formed of metal, the container 29 is rigid and cassette supporting strength is increased. Vaporization acceleration effect equivalent to that of the first embodiment can be obtained.

The container 29 may be formed of other metals such as copper, iron, stainless steel and the like and may be even a container of plastic molding. Further also the container 22 in the first and second embodiments may be formed of, for instance, metal foil, laminated material of metal foil and plastic film in place of plastic film.

[Fourth embodiment]

Figure 6:
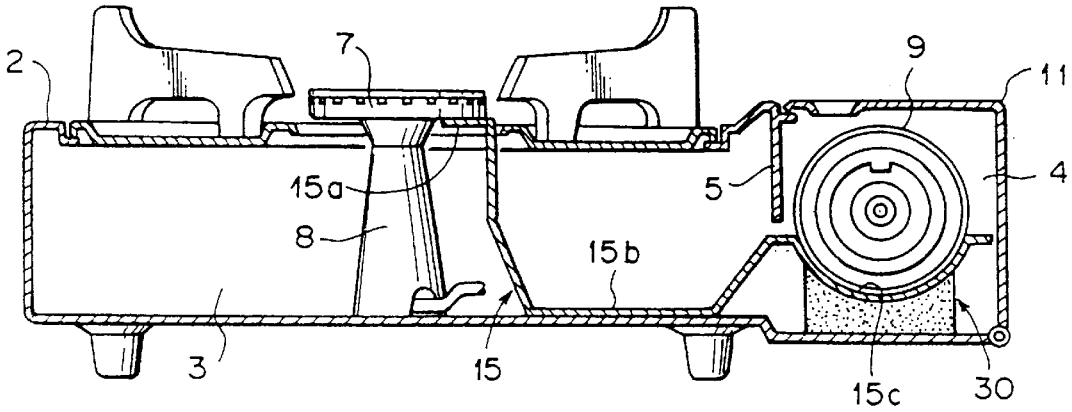
FIG. 6 is a schematic cross-sectional view of a gas appliance provided with a vaporization acceleration device in accordance with a fourth embodiment of the present invention.

The vaporization acceleration device of this embodiment is shown in FIG. 6 and is provided with the same heat transfer plate 15 as in the first embodiment but with a heat accumulator member different from that of the first embodiment.

In this embodiment, the heat accumulator member 30 comprises a solid heat accumulator material such as brick, a metal block, paper clay, concrete, molded resin or the like. It is preferred that the heat accumulator member 30 be formed of a material which is large in specific heat and high in thermal conductivity. The heat accumulator member 30 is the similar in shape to the metal container 29 in the third embodiment and is disposed under the heat releasing portion 15*c* of the heat transfer plate 15 in a close contact with the heat releasing portion 15*c*.

The heat accumulator member 30 accumulates sensible heat equivalent to the heat capacity of the heat accumulator material corresponding to its specific heat, and supplies heat according to the temperature difference between the heat accumulator member 30 and the cassette 9 without change in phase. In this embodiment, vaporization acceleration effect substantially equivalent to that in the first embodiment can be obtained.

[Fifth embodiment]

Figure 7:
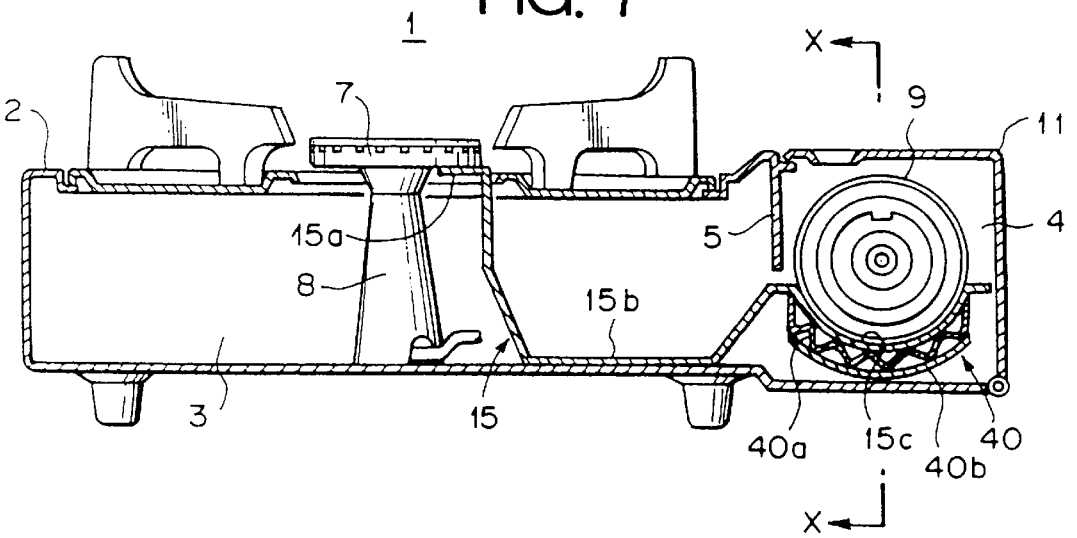
FIG. 7 is a schematic cross-sectional view of a gas appliance provided with a vaporization acceleration device in accordance with a fifth embodiment of the present invention.
Figure 8:
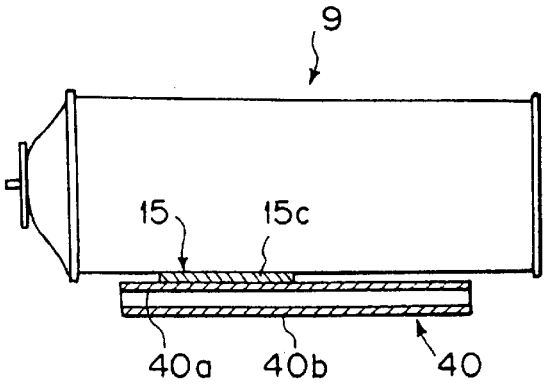
FIG. 8 is a cross-sectional view taken along line X—X in FIG. 7 showing only an important part of the gas appliance.

The vaporization acceleration device of this embodiment is shown in FIGS. 7 and 8 and is provided with the same heat transfer plate 15 as in the first embodiment but with a heat exchanger member in place of the heat accumulator member.

A heat exchanger member 40 which exchanges heat with the air is disposed under the heat releasing portion 15*c* of the heat transfer plate 15. The heat exchanger member 40 is of a honeycomb-sandwich comprising a corrugated plate 40*a* of a high thermal conductive material such as aluminum fixed to the lower side of the heat releasing portion 15*c* and a back plate 40*b* bonded to the outer surface of the corrugated plate 40*a*. The honeycomb-sandwich structure increases the surface area of the heat exchanger member 40.

As shown in FIG. 8, the heat exchanger member 40 is fixed to the lower surface of the heat releasing portion 15*c* of the heat transfer plate 15 and extends across the heat transfer plate 15 to be in a direct contact with the cassette 9 at the extension.

Specifically the corrugated plate 40*a* is formed of an aluminum plate of 0.2 mm thick and is 8 in the number of corrugations, 5 mm in height of the corrugations, 55 mm in width and 130 mm in length.

With the arrangement of this embodiment, when the cassette 9 is set and high-calorie burning is initiated at the burner 7, the temperature of liquefied gas in the cassette 9 lowers due to vaporization latent heat absorbed upon vaporization of the liquefied gas in response to gas supply from the cassette 9. However heat absorbed from the air by the heat exchanger member 40 according to the temperature difference therebetween is supplied from the heat exchanger member 40 to the cassette 9 through the heat releasing portion 15*c* of the heat transfer plate 15.

As the temperature of the burner 7 increases due to burning at the burner 7, a part of heat of combustion is transferred through the heat transfer plate 15 and is supplied to the cassette 9 from the heat releasing portion 15*c*. As in the preceding embodiments, after a certain time (6 to 7 minutes) elapses after ignition, heat is stably supplied through the heat transfer plate 15.

When heat supply from the heat transfer plate 15 and the heat exchanger member 40 and heat absorption due to vaporization latent heat attain equilibrium, the cassette 9 is kept at a certain constant temperature and the gas pressure in the cassette 9 is held at a vapor pressure corresponding to the temperature, whereby a stable amount of gas supply is obtained and rapid drop in gas pressure and gas supply can be prevented.

When heat transferred through the heat transfer plate 15 becomes more than necessary due to increase in the environmental temperature or the temperature of the cassette 9 becomes higher than the temperature of the air, a part of the heat transferred is released to the air through the heat exchanger member 40, thereby preventing the cassette 9 from being excessively heated.

Using the gas appliance 1 with the vaporization acceleration device provided with such a heat transfer plate 15 and the heat exchanger member 40, a cassette 9 containing therein liquefied gas was set to the gas appliance 1 and change in caloric force until the liquefied gas was exhausted and the gas appliance 1 was spontaneously quenched was measured with the caloric force is initially set at 260 kcal/hr. The result of the burning experiment (experiment 2 which will be described later) is shown by dashed line G in FIGS. 17 to 19.

Though in the above embodiment, the vaporization acceleration device is formed by fixing the heat exchanger member to the heat transfer plate, an end portion of the heat transfer plate may be connected to the heat exchanger member with the heat exchanger member in contact with the cassette 9 so that heat transfer can be effected.

Specifically, the heat exchanger member is formed into a honeycomb-sandwich structure comprising a face plate, a corrugated plate and a back plate, and is disposed so that the face plate supports the cassette and is in a thermal contact therewith. Then the heat release side end portion of the heat transfer plate is thermally connected to the face plate. Such a relation between the heat transfer plate and the heat exchanger member can be also applied to sixth to tenth embodiments to be described later.

[Sixth embodiment]

Figure 9:
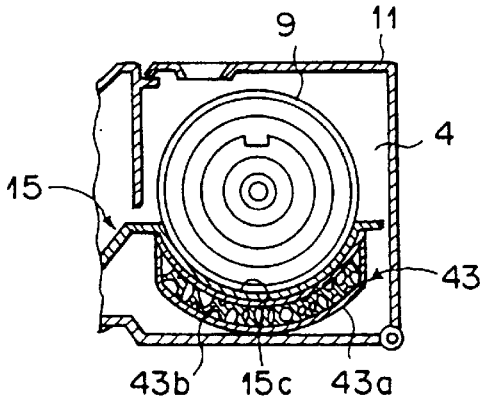
FIG. 9 is a fragmentary schematic cross-sectional view showing an important part of a gas appliance provided with a vaporization acceleration device in accordance with a sixth embodiment of the present invention.

The vaporization acceleration device of this embodiment is shown in FIG. 9 and differs from the preceding embodiment in the structure of the heat exchanger member.

The heat exchanger member 43 of this embodiment is of a honeycomb structure comprising an outer shell portion 43*a* formed by extrusion or the like of aluminum (alloy) and a porous honeycomb portion 43*b* contained the outer shell portion 43*a*. The heat exchanger member 43 is fixed to the lower surface of the heat releasing portion 15*c* of the heat transfer plate 15 as in the preceding embodiment. Because its high thermal conductive material and its large surface area, the heat exchanger member 43 is high in its heat exchange performance and supplies heat absorbed from the air to accelerate vaporization and at the same time releases excessive heat to the air to prevent the temperature of the cassette from being abnormally increased. The other structure is the same as the fifth embodiment.

[Seventh embodiment]

Figure 10:
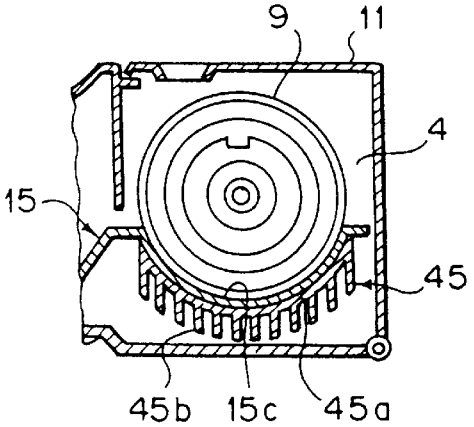
FIG. 10 is a fragmentary schematic cross-sectional view showing an important part of a gas appliance provided with a vaporization acceleration device in accordance with a seventh embodiment of the present invention.

The vaporization acceleration device of this embodiment is shown in FIG. 10 and differs from the fifth embodiment in the structure of the heat exchanger member.

The heat exchanger member 45 of this embodiment is of a fin structure comprising an arcuate face plate 45*a* which is formed by extrusion or the like of aluminum (alloy) and fixed to the heat transfer plate 15, and plate-like fin portions 45*b* which extend downward in parallel to each other. The fin structure is fixed to the heat transfer plate. The other structure is the same as the fifth embodiment and has the same effect.

[Eighth embodiment]

Figure 11:
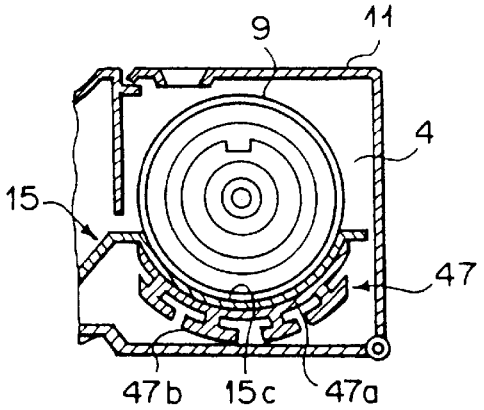
FIG. 11 is a fragmentary schematic cross-sectional view showing an important part of a gas appliance provided with a vaporization acceleration device in accordance with an eighth embodiment of the present invention.

The vaporization acceleration device of this embodiment is shown in FIG. 11 and differs from the fifth embodiment in the structure of the fin structure of the heat exchanger member.

The fin structure of the heat exchanger member 47 of this embodiment comprises an arcuate face plate 47*a* which is fixed to the lower side of the heat transfer plate 15, and fin portions 47*b* which extend downward and are T-shaped in cross-section. The other structure is the same as the fifth embodiment and has the same effect.

[Ninth embodiment]

Figure 12:
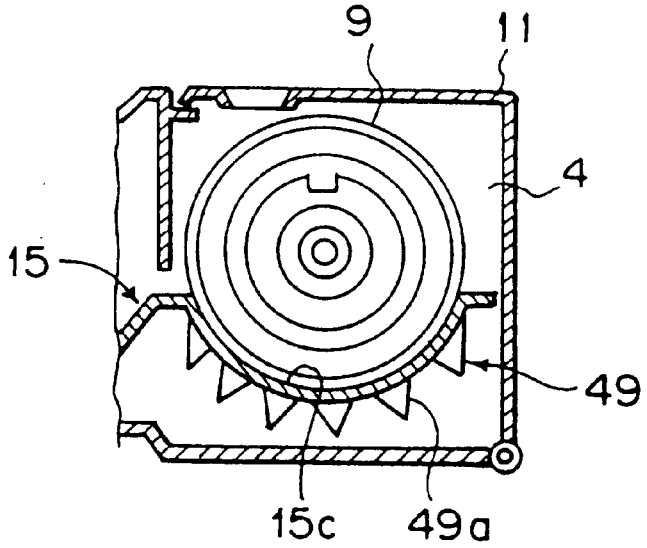
FIG. 12 is a fragmentary schematic cross-sectional view showing an important part of a gas appliance provided with a vaporization acceleration device in accordance with a ninth embodiment of the present invention.

The vaporization acceleration device of this embodiment is shown in FIG. 12 and differs from the fifth embodiment in the structure of the heat exchanger member.

The heat exchanger member 49 of this embodiment comprises a corrugated body 49*a* formed by bending metal foil such as of aluminum into a triangular wave shape, thereby increasing the surface area, and fixed to the lower surface of the heat transfer plate 15. The other structure is the same as the fifth embodiment and has the same effect.

[Tenth embodiment]

Figure 13:
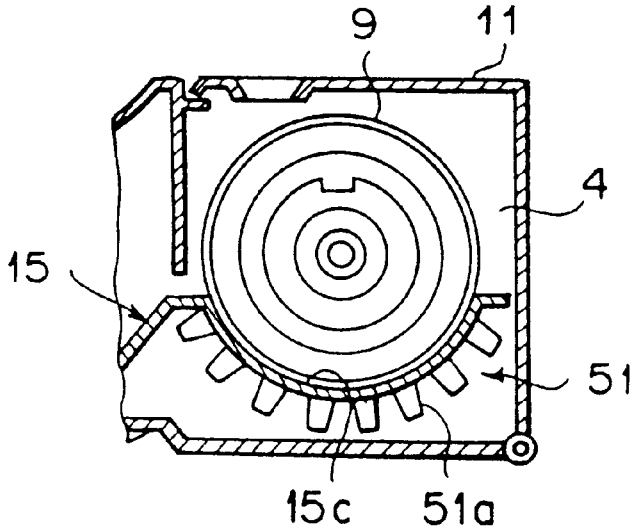
FIG. 13 is a fragmentary schematic cross-sectional view showing an important part of a gas appliance provided with a vaporization acceleration device in accordance with a tenth embodiment of the present invention.

The vaporization acceleration device of this embodiment is shown in FIG. 13 and differs from the ninth embodiment in the shape of the heat exchanger member.

The heat exchanger member 51 of this embodiment comprises a corrugated body 51*a* formed by bending metal foil such as of aluminum into a pulse-wave shape, thereby increasing the surface area, and fixed to the lower surface of the heat transfer plate 15. The other structure is the same as the fifth embodiment and has the same effect.

[Experiment 1]

Figure 14:
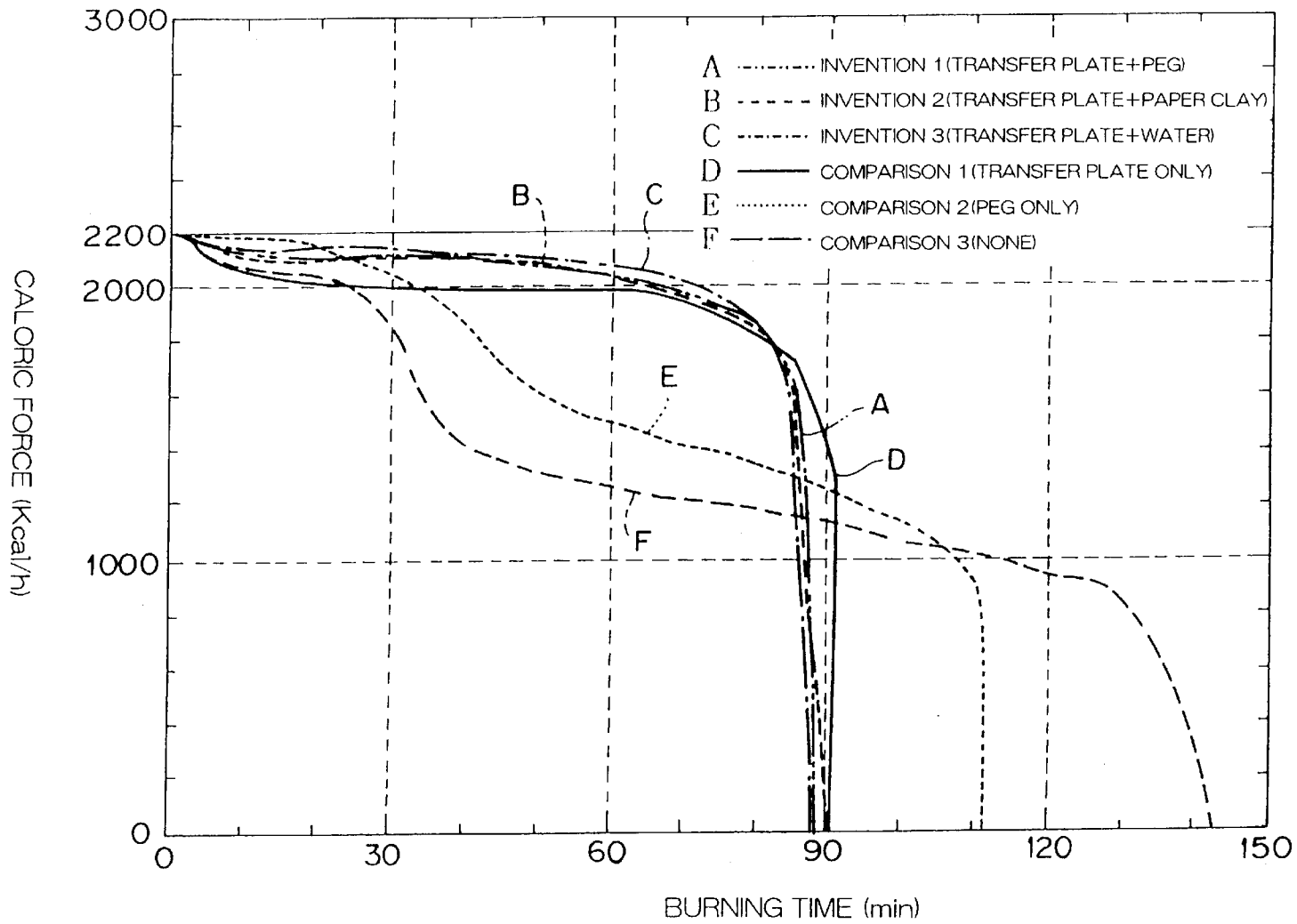
FIG. 14 is a graph showing a result of measurement of change in caloric force versus burning time where the amount of liquefied gas upon initiation of burning was 250 g in a first experiment.
Figure 15:
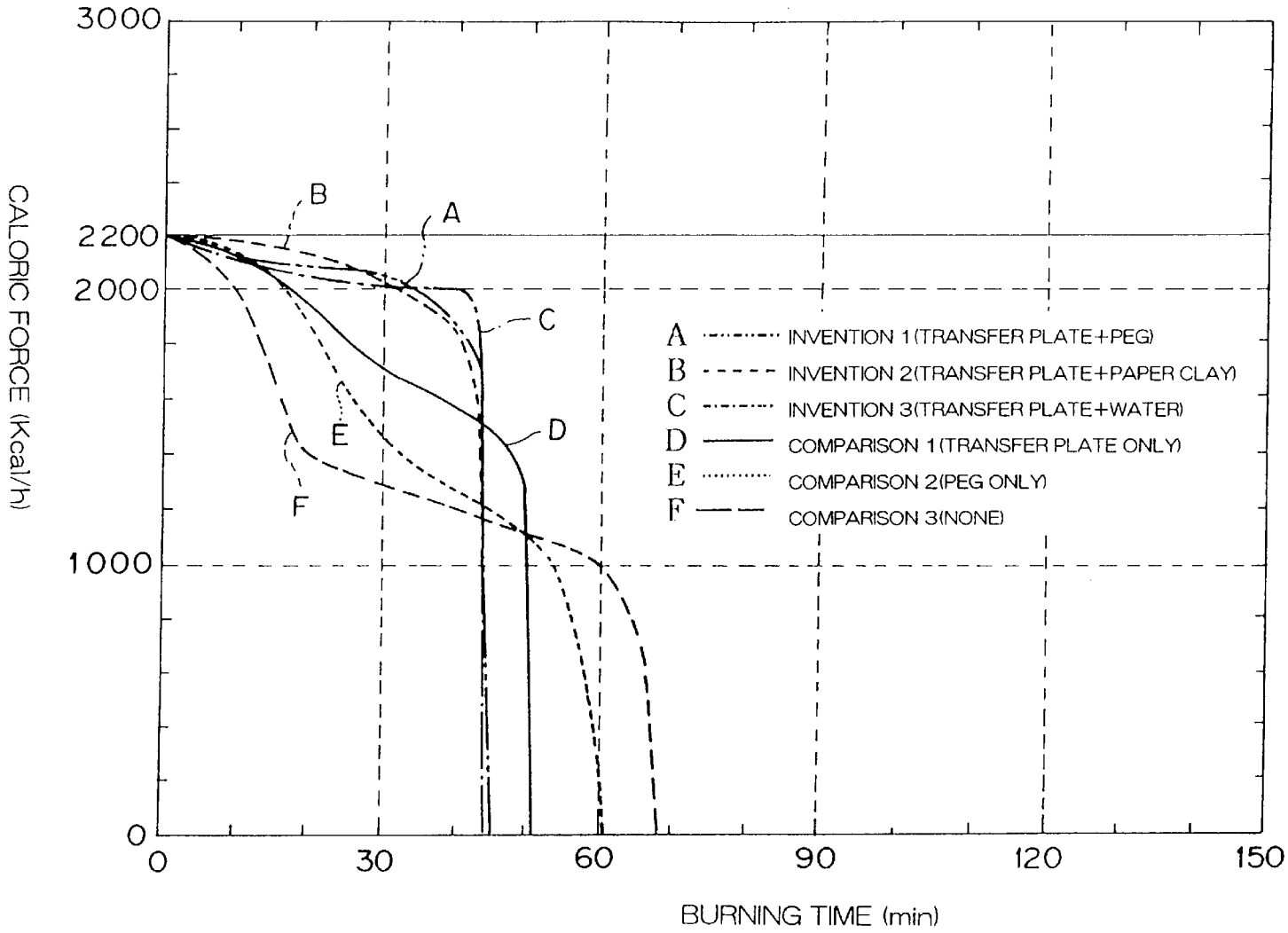
FIG. 15 is a graph showing a result of measurement of change in caloric force versus burning time where the amount of liquefied gas upon initiation of burning was 125 g in the first experiment.
Figure 16:
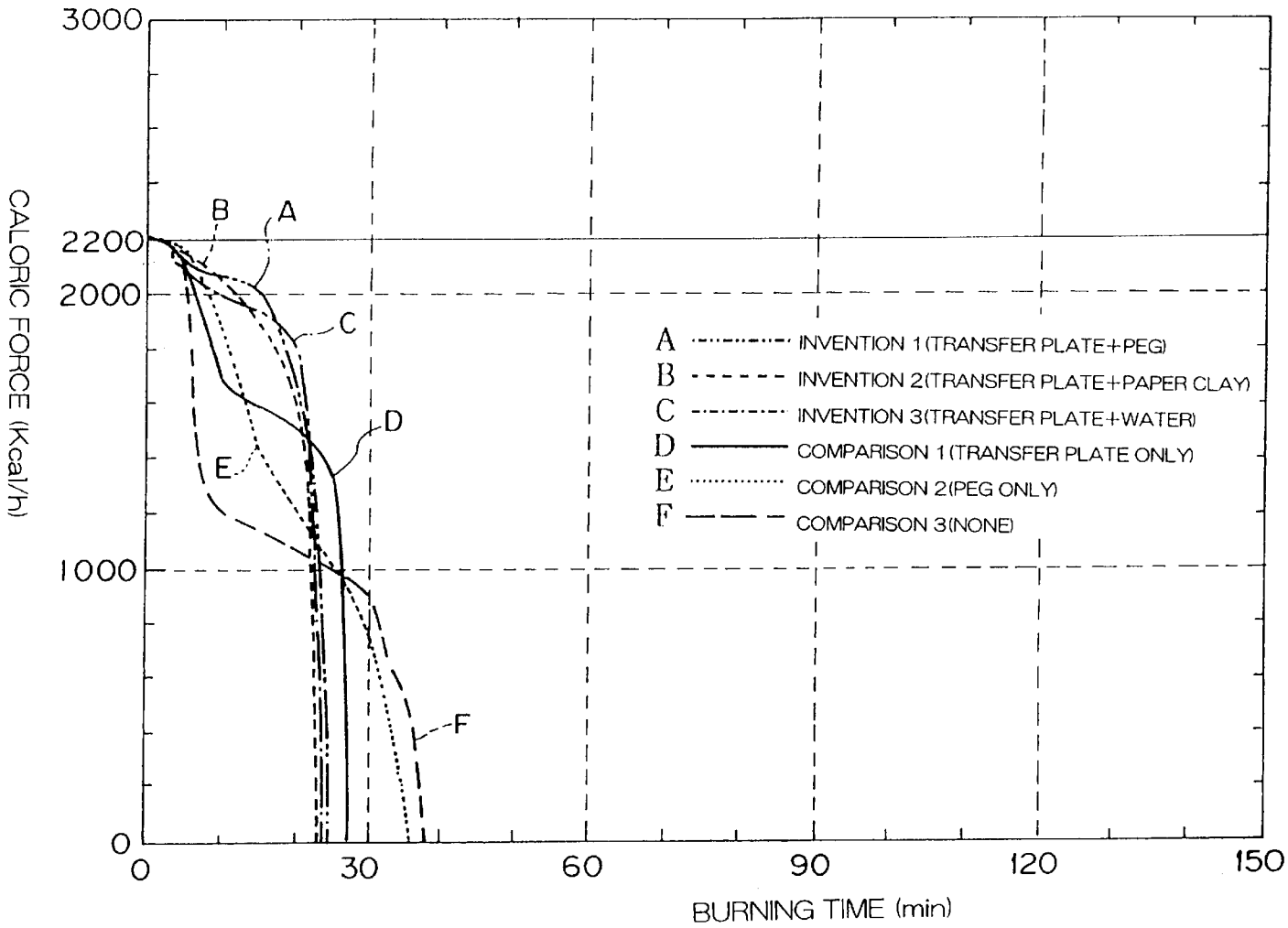
FIG. 16 is a graph showing a result of measurement of change in caloric force versus burning time where the amount of liquefied gas upon initiation of burning was 60 g in the first experiment.

Using the gas appliance in accordance with the first embodiment, a burning experiment was carried out wherein change in caloric force until the liquefied gas was exhausted and the gas appliance 1 was spontaneously quenched was measured with the caloric force initially set at 2200 kcal/hr. The result of the burning experiment is shown in FIGS. 14 to 16 together with comparisons where a gas appliance was provided with a heat transfer plate only, a heat accumulator member only and neither of them. FIG. 14 shows the case where the amount of liquefied gas in the cassette upon ignition was 250 g (full), FIG. 15 shows the case where the amount of liquefied gas in the cassette upon ignition was 125 g, and FIG. 16 shows the case where the amount of liquefied gas in the cassette upon ignition was 60 g.

In this experiment, as the vaporization acceleration devices of the present invention, there were used one provided with a heat transfer plate as in the first embodiment and a heat accumulator member containing therein 100 mL of a heat accumulator material of polyethylene glycol (invention 1: shown by chained line A), one provided with a similar heat transfer plate and a heat accumulator member comprising a solid heat accumulator material of paper clay (invention 2: shown by dashed line B), and one provided with a similar heat transfer plate and a heat accumulator member containing therein 100 mL of water (invention 3: shown by chained line C).

Comparison 1 shown by solid line D was provided with a heat transfer plate only, comparison 2 shown by dotted line E was provided with a heat accumulator member of polyethylene glycol only and comparison 3 shown by dashed line F was provided with neither of the heat transfer plate and the heat accumulator member.

When the comparison 1 provided with the heat transfer plate only (curve D) and the comparison 2 provided with neither (curve F) are compared, it can be seen that in the case of FIG. 14 where the liquefied gas in the cassette was initially 250 g, when the gas appliance is provided with the heat transfer plate, burning was successfully continued until the liquefied gas was exhausted with the vaporization latent heat due to gas supply from the cassette and the heat supply through heat transfer plate attaining equilibrium. To the contrast, in the comparison 3, since there was no heat supply through the heat transfer plate, the liquefied gas was cooled by the vaporization latent heat due to gas supply from the cassette and the gas pressure was lowered to reduce gas supply, i.e., caloric force. Thus burning continued with a small flame. If burning was interrupted in this state, some liquefied gas would remain in the cassette.

When the comparison 1 and the comparison 3 are compared on the basis of FIG. 15, since the initial amount of gas in the cassette is small, the liquefied gas was rapidly cooled in response to gas supply at a flow rate required to burning and equilibrium gas pressure was lowered, whereby gas supply to the burner 7 was reduced. Accordingly even in the comparison 1 (curve D), heat supply through the heat transfer plate was reduced and heat equilibrium could not be maintained unlike in FIG. 14. Accordingly though higher than the comparison 3 (curve F), the caloric force was reduced with time. In this case, the flame became short. If burning was interrupted in this state, some liquefied gas would remain in the cassette. Further when the initial amount of gas was less as in FIG. 16, heat equilibrium could not be attained solely by the heat transfer plate and the caloric force rapidly lowered.

It can be seen that, in the comparison 1 provided with a heat transfer plate only, though burning can be continued when the initial amount of gas is 250 g, it becomes difficult to maintain burning as the initial amount of gas reduces. Generally it seldom occurs that a virgin cassette is set to a gas appliance and burning is continued until the cassette is exhausted. It is often the case where burning is interrupted and burning is started again with a reduced amount of liquefied gas in the cassette. The state of burning largely depends upon the amount of liquefied gas in the cassette upon initiation of burning, and if the amount of liquefied gas in the cassette upon initiation of burning is small, it becomes difficult to maintain burning and to exhaust the cassette of liquefied gas.

In the case of the comparison 2 (curve E) provided with the heat accumulator member (polyethylene glycol: fusing point 10° C.) only, caloric force tends to lower with time relatively linearly as compared with the comparison 1 provided with the heat transfer plate only (curve D). Also in the case of the comparison 2, lowering caloric force becomes sharp as the initial amount of liquefied gas becomes smaller.

In the case of the heat accumulator member, heat supply from the heat accumulator member is rapid in response to temperature drop of the cassette and the liquefied gas in the early stages of burning. However transfer of heat occurs at a portion near the contact surface with the cassette and heat transfer from the inside of the heat accumulator member to the contact portion is insufficient. Heat transfer from the inside of the heat accumulator member by conduction and or convection lags behind cooling of the cassette and the temperature of the cassette gradually lowers. As compared with the comparison 1 provided with the heat transfer plate, caloric force drop is larger in the comparison 1 in the early stages of burning and after burning for a certain time, caloric force drop becomes larger in the comparison 2. When sodium sulfate decahydrate is employed as the heat accumulator material, caloric force drop occurs similarly to the comparison 2. However the caloric force drop is smaller than in polyethylene glycol under the condition of experiment described above.

To the contrast with the comparisons 1 to 3, in the case of the inventions 1 to 3 (curves A to C), satisfactory caloric force could be maintained by use of both the heat transfer plate and the heat accumulator member. Though when the initial amount of gas was 250 g (FIG. 14), there was no large difference between the comparison 1 provided with the heat transfer plate only and the inventions 1 to 3, the burning state was much better in the inventions 1 to 3 than in the comparison 1 when the initial amount of gas is small (FIGS. 15 and 16).

That is, in the early stages of burning, suppression of caloric force drop by the heat accumulator member is more effective than that by the heat transfer plate and after burning is continued for a certain time, suppression of caloric force drop by the heat transfer plate becomes more effective than that by the heat accumulator member. Such properties are substantially the same in the inventions 1 and 3. Substantially the same result was obtained for the heat accumulator material of polyethylene glycol (liquid latent heat accumulator material), water (liquid sensible heat accumulator material) and paper clay (solid heat accumulator material).

When water is employed as the heat accumulator material, the amount of water used little affects the result since the heat accumulator material is used together with the heat transfer plate. When the amount of water is reduced to 25 mL, caloric force drop in the early stages of burning is somewhat enlarged for case where the initial amount of gas is 60 g. However another experiment proved that caloric force sufficient to exhaust the cassette was maintained.

The above burning test was carried out under normal temperatures. When the environmental temperature is low, e.g., not higher than 10° C., and polyethylene glycol is in a solid state, latent heat cannot be used to heat the cassette and the temperature drop of the cassette should be suppressed by heat supply utilizing sensible heat.

In the case where both the heat transfer plate and the heat accumulator member are used, when heat supply through the heat transfer plate becomes excessive under high environmental temperatures, heat flows to both the cassette and the heat accumulator member since the heat transfer plate is in contact with both of them, whereby the cassette can be prevented from being overheated. In this regard, the quantity of heat to be transferred through the heat transfer plate may be larger than when the heat transfer plate only is used, which permits the heat transfer plate to be designed giving weight to improvement of performance on the low temperature side.

[Experiment 2]

Figure 17:
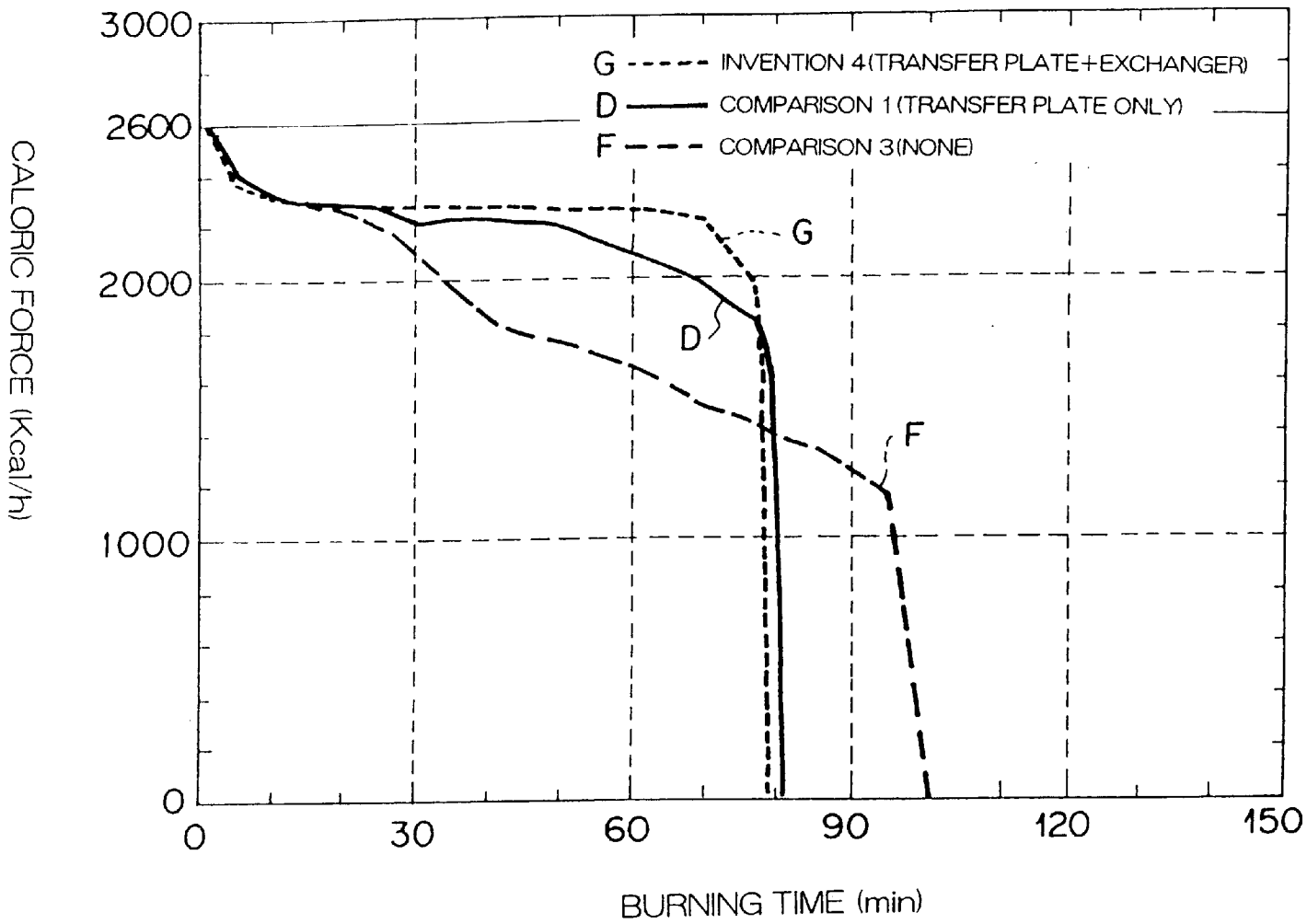
FIG. 17 is a graph showing a result of measurement of change in caloric force versus burning time where the amount of liquefied gas upon initiation of burning was 250 g in a second experiment.
Figure 18:
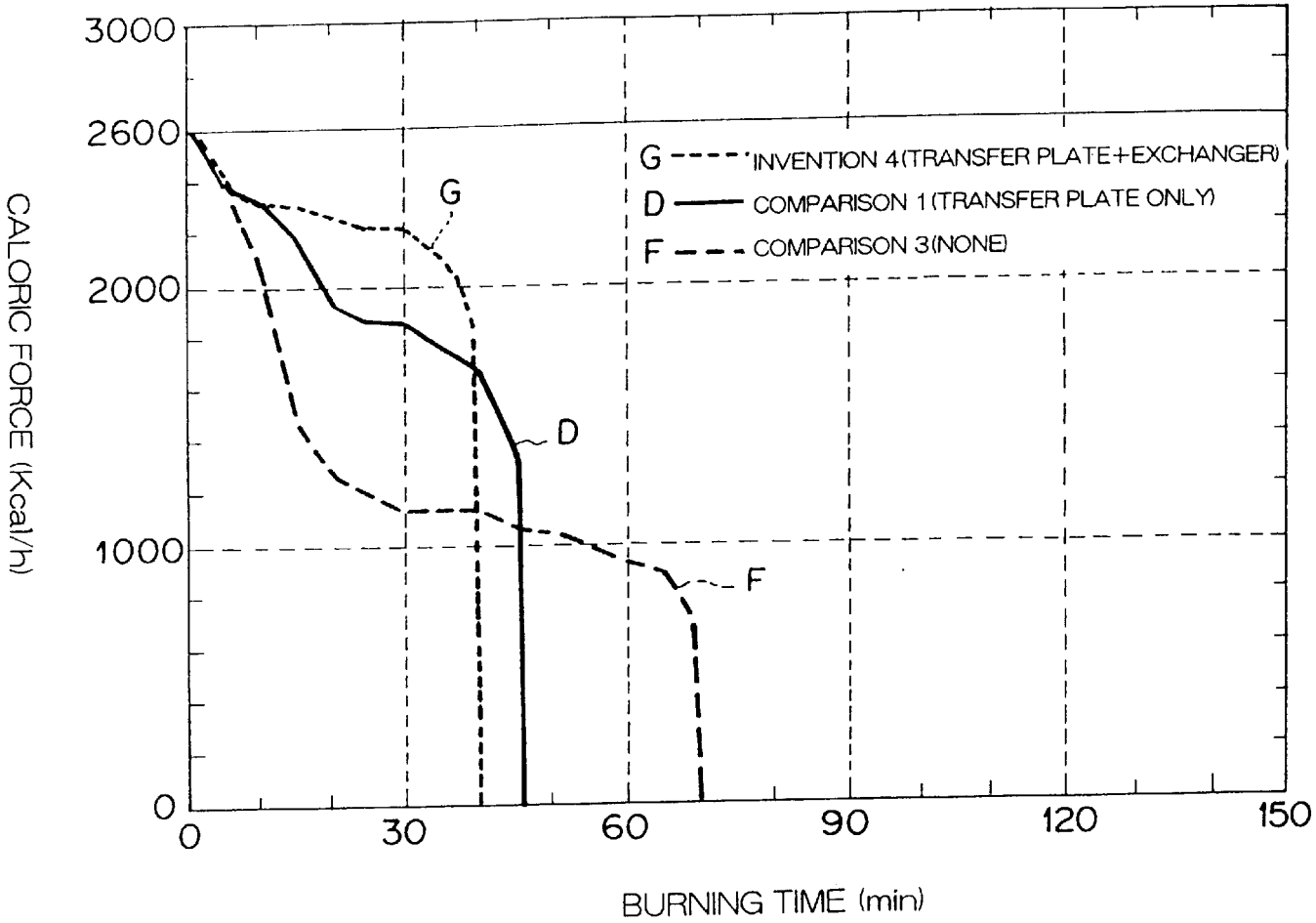
FIG. 18 is a graph showing a result of measurement of change in caloric force versus burning time where the amount of liquefied gas upon initiation of burning was 125 g in the second experiment.
Figure 19:
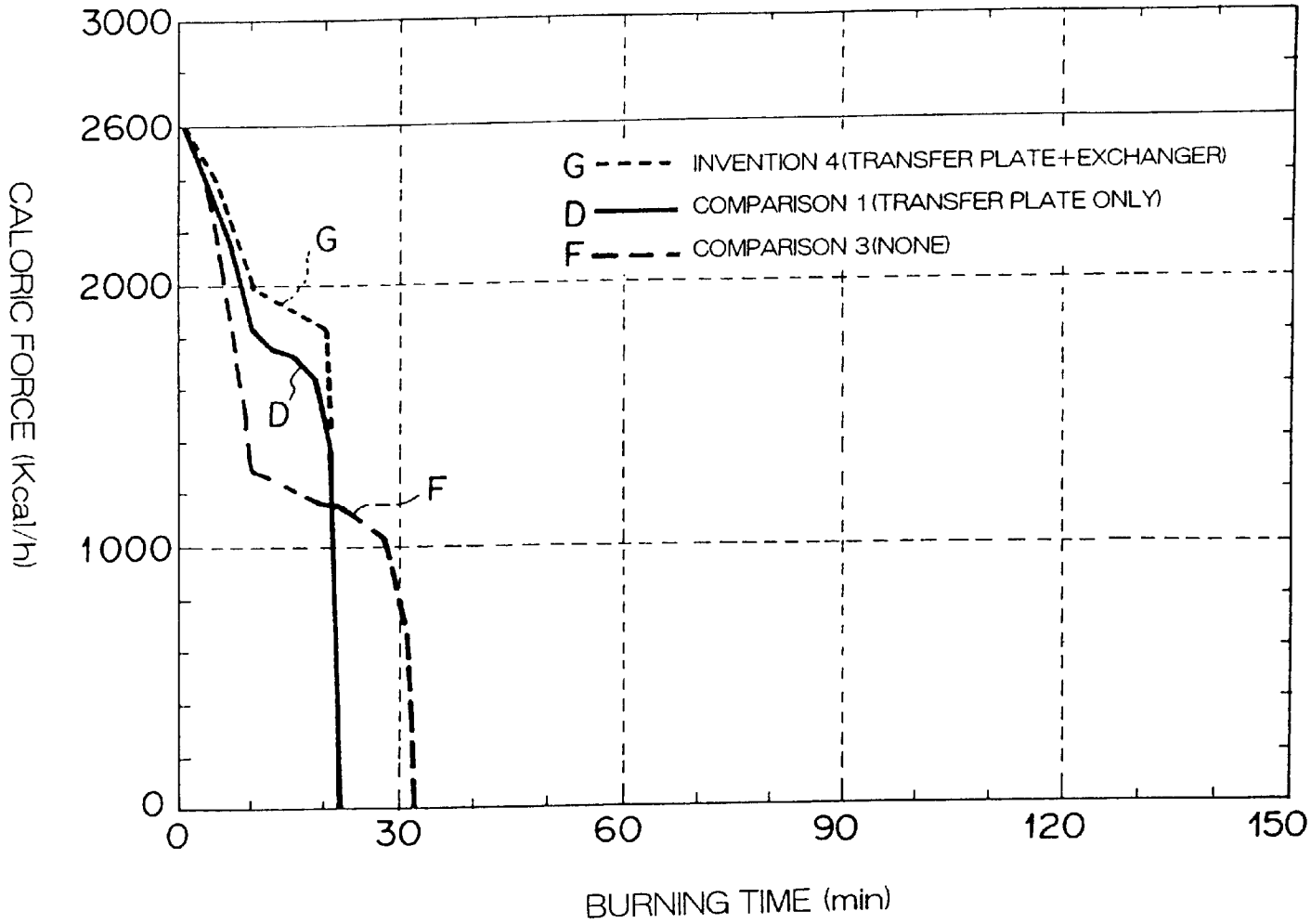
FIG. 19 is a graph showing a result of measurement of change in caloric force versus burning time where the amount of liquefied gas upon initiation of burning was 60 g in the second experiment.

Using the gas appliance in accordance with the fifth embodiment, a burning experiment was carried out wherein change in caloric force until the liquefied gas was exhausted and the gas appliance was spontaneously quenched was measured with the caloric force initially set at 2600 kcal/hr. The result of the burning experiment is shown in FIGS. 17 to 19 together with comparisons where a gas appliance was provided with a heat transfer plate only, and neither a heat transfer plate nor a heat exchanger member. FIG. 17 shows the case where the amount of liquefied gas in the cassette upon ignition was 250 g (full), FIG. 18 shows the case where the amount of liquefied gas in the cassette upon ignition was 125 g, and FIG. 19 shows the case where the amount of liquefied gas in the cassette upon ignition was 60 g.

In this experiment, as the vaporization acceleration devices of the present invention, there was used one provided with a heat transfer plate and a heat exchanger member as in the fifth embodiment (invention 4: shown by dashed line G). Comparison 1 shown by solid line D was provided with a heat transfer plate only, and comparison 3 shown by dashed line F was provided with neither the heat transfer plate nor the heat exchanger member.

When the comparison 1 provided with the heat transfer plate only (curve D) and the comparison 2 provided with neither (curve F) are compared with the result of the first experiment (FIGS. 14 to 16), the result of the second embodiment was substantially the same as the first embodiment as a whole though, due to a higher set caloric force, it took a shorter time in the second experiment than in the first experiment for the gas appliance to be quenched and the caloric force drop with increase in the vaporization latent heat in the early stages of burning was more rapid.

To the contrast with the comparisons, in the case of the invention 4 (curve G), satisfactory caloric force could be maintained by use of both the heat transfer plate and the heat exchanger member. Especially caloric force drop after equilibrium was attained was small and the caloric force was maintained much better than in the comparison 1 (curve D) provided with the heat transfer plate only irrespective of the initial amount of gas. It should be noted a high caloric force was maintained up to the time just before quenching, which proved an excellent vaporization acceleration effect of the vaporization acceleration device of the fifth embodiment.

[Experiment 3]

Figure 20:
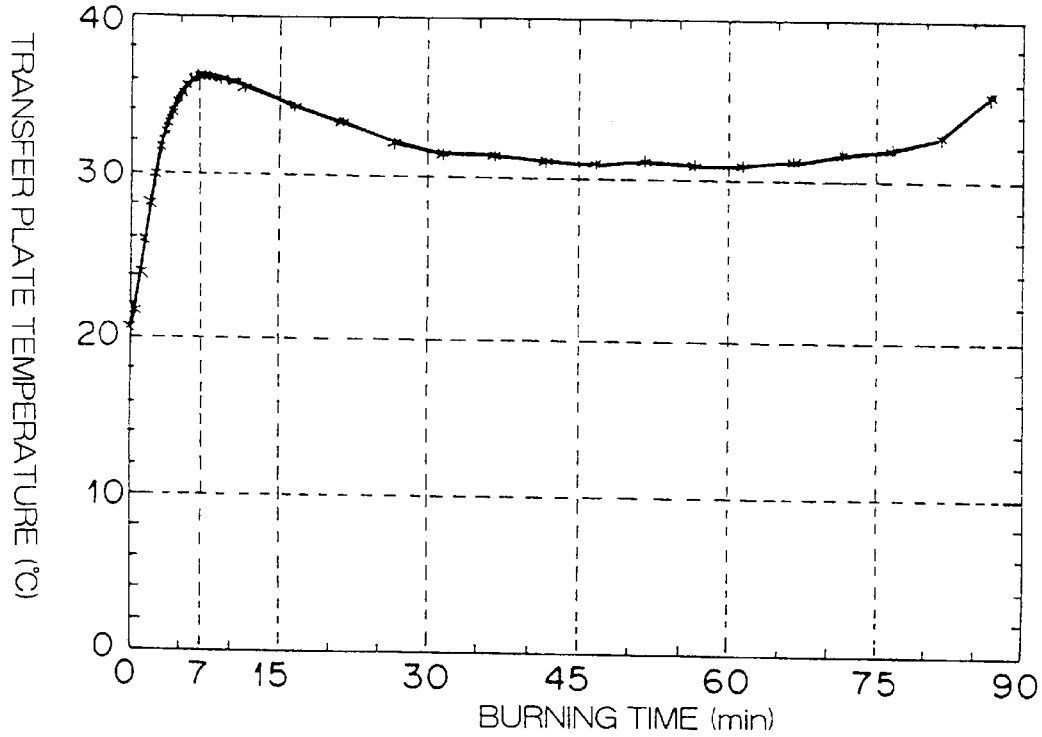
FIG. 20 is a graph showing a result of measurement of change in temperature of the heat transfer plate versus burning time in a third experiment.

The quantity of heat transferred through the heat transfer plate used in the first experiment was measured. The result is shown in FIGS. 20 to 22. In the first experiment, the heat accumulator member was removed from the arrangement of the invention 1 with the heat transfer plate left as it was and the gas appliance was ignited under the same conditions as in FIG. 14. In this case, the heat transfer plate releases heat during transfer of heat from the burner and a temperature gradient was established toward the heat releasing portion. It took 6 to 7 minutes for heat equilibrium to attain.

FIG. 20 shows change in the temperature of the heat transfer plate versus the burning time. The temperature of the heat transfer plate was measured at a portion slightly short of the heat releasing portion 15*c* (FIG. 3), i.e., at a distance of 140 mm from the heat receiving portion 15*a*. FIG. 21 shows the temperatures at various points on the heat transfer plate after burning was continued fro 45 minutes. As can be seen from FIGS. 20 and 21, the temperature of the heat transfer plate was sharply increased after initiation of burning and was stabilized 7 minutes after. At the same time, heat was dissipated during transfer of heat and the temperature of the heat transfer plate was lowered with increase in the distance from the heat receiving portion.

Figure 22:
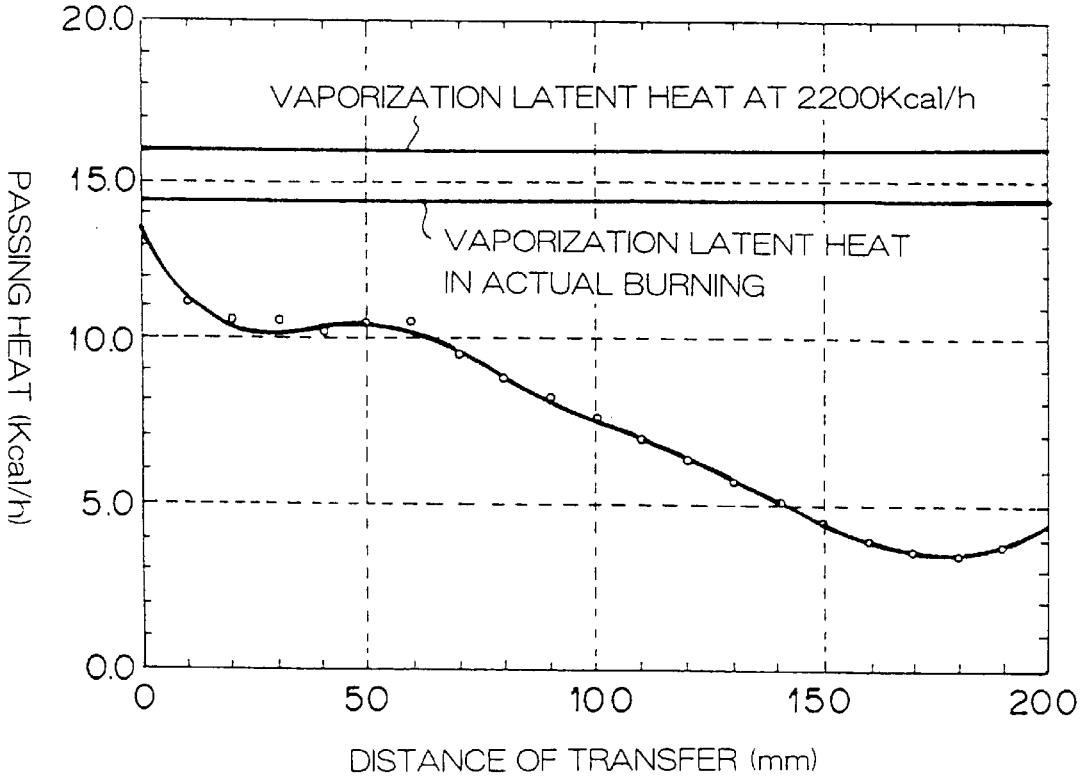
FIG. 22 is a graph showing a result of measurement of quantities of heat passing through various parts of the heat transfer plate in the third experiment.
Figure 23:
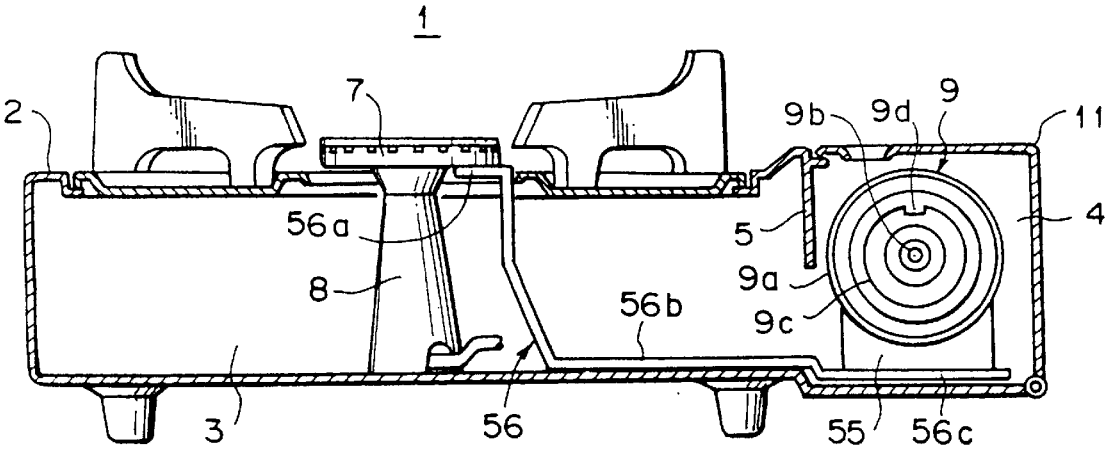
FIG. 23 is a schematic cross-sectional view of a gas appliance provided with a vaporization acceleration device in accordance with an eleventh embodiment of the present invention.
Figure 24:
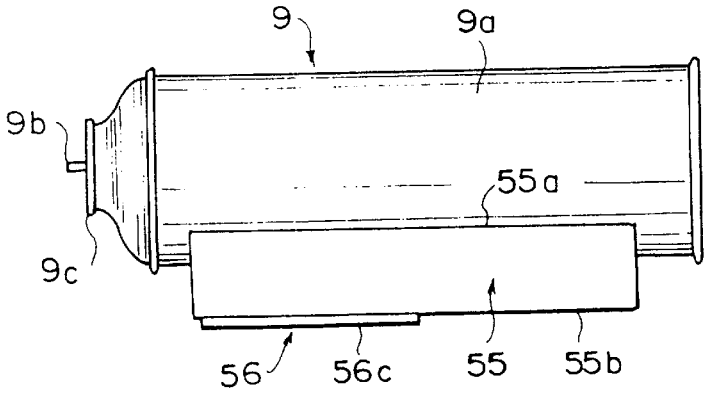
FIG. 24 is a fragmentary side view showing an important part of the cassette receiving portion shown in FIG. 23.

FIG. 22 shows the quantities of heat to be transferred to various points on the heat transfer plate determined on the basis of temperature measurement described above. As can be seen from FIG. 14, the actual caloric force was about 2000 kcal/hr. The vaporization latent heat for an amount of liquefied gas required for burning at 2000 kcal/hr is about 14.5 kcal/hr. For this value, the quantity of heat passing through the heat releasing portion 15*c* (150 to 200 mm in distance of heat transfer), i.e., the quantity of heat released from the heat releasing portion 15*c* was 3.5 to 4 kcal/hr as can be seen from FIG. 22, which was about 24 to 28% of the quantity of heat required.

A problem in heat supply through the heat transfer plate is the time (about 7 minutes) required for the temperature of the heat transfer plate to attain equilibrium after ignition. When no heat supply to the cassette is made for this period, the temperature of the liquefied gas rapidly lowers. However in accordance with the present invention, heat is supplied supply from the heat accumulator member or the heat accumulator member suppresses rapid temperature drop of the liquefied gas for the period.

The quantity of heat to be supplied from the heat accumulator member is set depending on the heat capacity of the heat accumulator member, which depends upon the material and the amount of heat accumulator material, an area over which the heat accumulator member is in contact with the cassette and the heat conductive properties of the contacting portion so that a predetermined quantity of heat can be supplied to the cassette during the early stages of burning up to the time heat supply through the heat transfer plate becomes sufficient. Similarly the quantity of heat to be supplied from the heat exchanger member is set depending on the heat exchange properties which depends on the thermal conductivity of the material, the shape and the dimensions.

[Eleventh embodiment]

The vaporization acceleration device of this embodiment is shown in FIGS. 23 to 26 and in this embodiment, a heat accumulator member of metal is directly brought into contact with the cassette.

Figure 25:
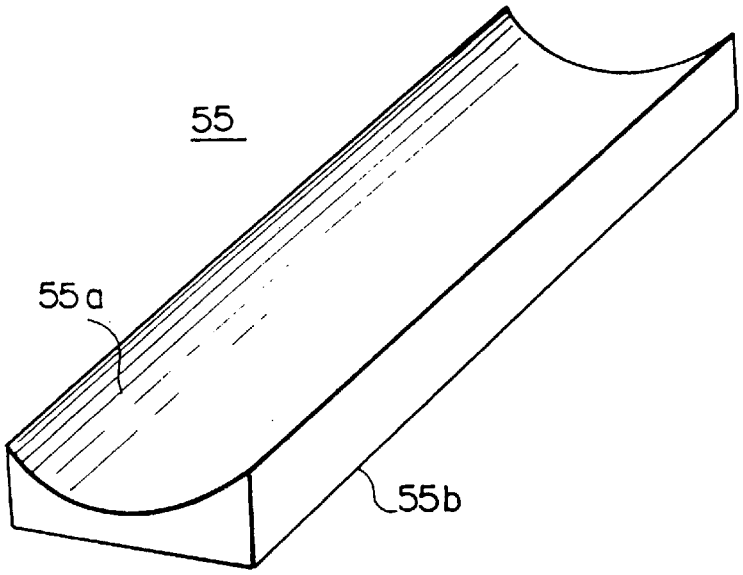
FIG. 25 is a perspective view of the heat accumulator member shown in FIG. 23.

The vaporization acceleration device comprises a heat accumulator member 55 formed of metal shown in FIG. 25. The heat accumulator member 55 is to be disposed on the bottom of the cassette receiving portion 4 and is formed by die casting of, for instance, zinc alloy (ZDC2). The heat accumulator member 55 has a contact surface 9*a* on the upper surface thereof. The contact surface 9*a* is arcuated to conform to the outer peripheral surface of the barrel 9*a* of the cassette 9. The heat accumulator member 55 is flat in its lower surface and is slightly smaller than the barrel 9*a* of the cassette 9 in length. The heat accumulator member 55 is in contact with the cassette 9 at the contact surface 9*a* and with a heat transfer plate 56 to be described later at its lower surface.

Specifically the heat accumulator member 55 is 50 mm in width, 130 mm in length, and 8 mm in thickness at the thinnest portion at the middle thereof. The volume is about 100 $cm^3$ and the heat capacity for change in temperature by 15° C. is 1000 cal.

Figure 26:
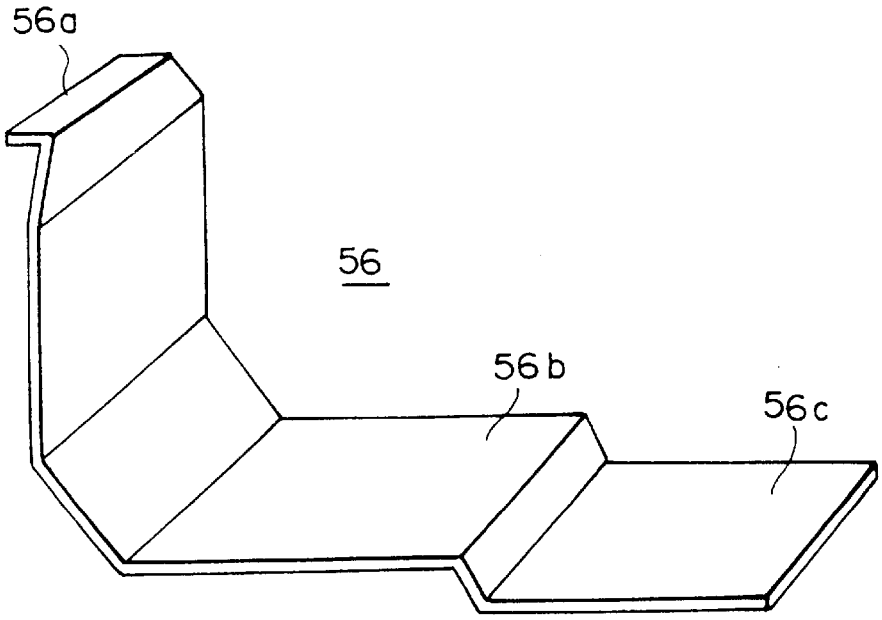
FIG. 26 is a perspective view of the heat transfer plate shown in FIG. 23.
Figure 27:
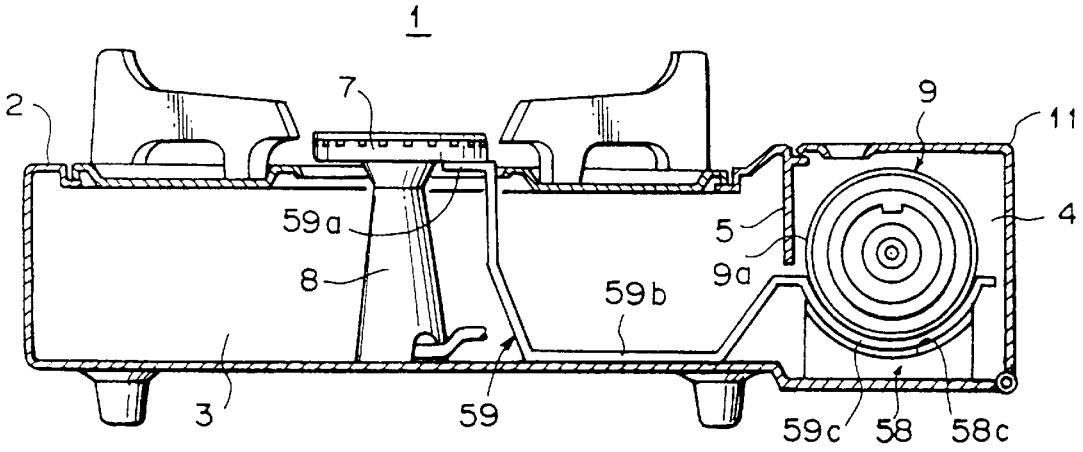
FIG. 27 is a schematic cross-sectional view of a gas appliance provided with a vaporization acceleration device in accordance with a twelfth embodiment of the present invention.
Figure 28:
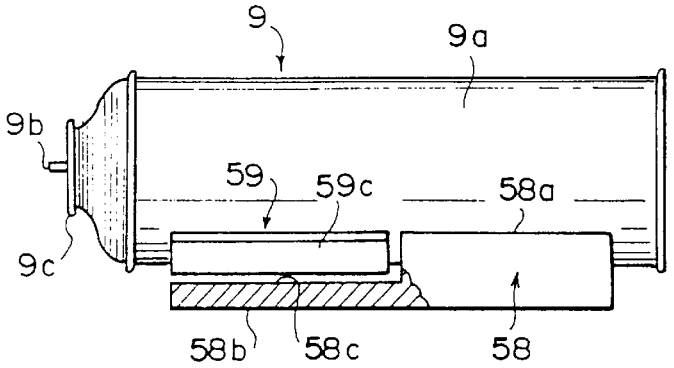
FIG. 28 is a fragmentary side view showing an important part of the cassette receiving portion shown in FIG. 27.

As shown in FIG. 26, the heat transfer plate 56 is a plate member formed of a high thermal conductive material such as aluminum. The heat transfer plate 56 is for connecting the burner 7 and the heat accumulator member 55. The heat transfer plate 56 comprises a flat intermediate portion 56*b* which extends along the bottom of the body portion 2. An end portion is erected from the intermediate portion 56*b* upward near the burner 7 and is bent horizontally to form a heat receiving portion 56*a*, which is fixed to the bottom of the burner 7. The heat receiving portion 56*a* is in contact with a part of the burner 7 and receives a part of heat of combustion at the burner. The heat received by the heat receiving portion 56*a* is transferred through the heat transfer plate 56 to the heat accumulator member 55 by way of a heat releasing portion 56*c* at the other end of the heat transfer plate 56 in contact with the heat accumulator member 55. The heat releasing portion 56*c* extends from the intermediate portion 56*b* below the partition plate 5 into the cassette receiving portion 4 flat along the bottom of the cassette receiving portion 4 and is fixed to the lower surface 55*b* of the heat accumulator member 55.

In this particular embodiment, the heat transfer plate 56 is formed of a pure aluminum plate which is 1.0 mm in thickness, 80 mm in width and 200 mm in length. When fuel gas burns at the burner 7 and the temperature of the burner 7 itself is elevated, the heat receiving portion 56*a* of the heat transfer plate 56 is heated and the heat of the heat receiving portion 56*a* is transferred through the heat transfer plate 56 toward the other end to heat the heat releasing portion 56*c*, whereby the cassette 9 is heated by way of the heat accumulator member 55.

The cassette 9 (can) comprises a cylindrical barrel 9*a* and a stem 9*b* of a valve mechanism is projected from an end of the barrel 9*a*. When the stem 9*b* is pushed, vaporized fuel gas is discharged. When the cassette 9 is set to the gas appliance 1, the cassette 9 is located by engagement of a notch 9*d* formed on a mounting cup 9*c* with an engagement projection (not shown) on the gas appliance 1 with the notch 9*d* normally faced upward.

With the arrangement of this embodiment, when the cassette 9 is set in the cassette receiving portion 4 and high-calorie burning is initiated at the burner 7, the temperature of liquefied gas in the cassette 9 lowers due to vaporization latent heat absorbed upon vaporization of the liquefied gas in response to gas supply from the cassette 9. However heat is supplied from the heat accumulator material 55 according to the temperature difference between the cassette 9 and the heat accumulator member 55. Since the heat accumulator member 55 is formed of metal which is high in thermal conductivity and heat inside the heat accumulator member 55 can be also quickly supplied to the cassette 9, rapid temperature drop of the cassette 9 in the early stages of burning can be effectively suppressed especially when the initial amount of liquefied gas in the cassette 9 is small, whereby vaporization of the liquefied gas is accelerated and burning at high calorie can be maintained.

As the temperature of the burner 7 increases due to burning at the burner 7, a part of heat of combustion is transferred through the heat transfer plate 56 and is supplied to the cassette 9 from the heat releasing portion 56*c* 6 to 7 minutes after ignition, which contributes in suppressing temperature drop of the liquefied gas. In the early stages of burning, heat is supplied mainly from the heat accumulator member 55 and after a certain time lapses after ignition, heat is supplied through the heat transfer plate 56.

When heat supply from the heat transfer plate 56 and the heat accumulator member 55 and heat absorption due to vaporization latent heat attain equilibrium, the cassette 9 is kept at a certain constant temperature and the gas pressure in the cassette 9 is held at a vapor pressure corresponding to the temperature, whereby a stable amount of gas supply is obtained and rapid drop in gas pressure and gas supply can be prevented, thereby preventing lowering in caloric force.

[Twelfth embodiment]

The vaporization acceleration device of this embodiment is shown in FIGS. 27 to 30 and in this embodiment, an end portion of the heat transfer plate is directly brought into contact with the cassette 9.

Figure 29:
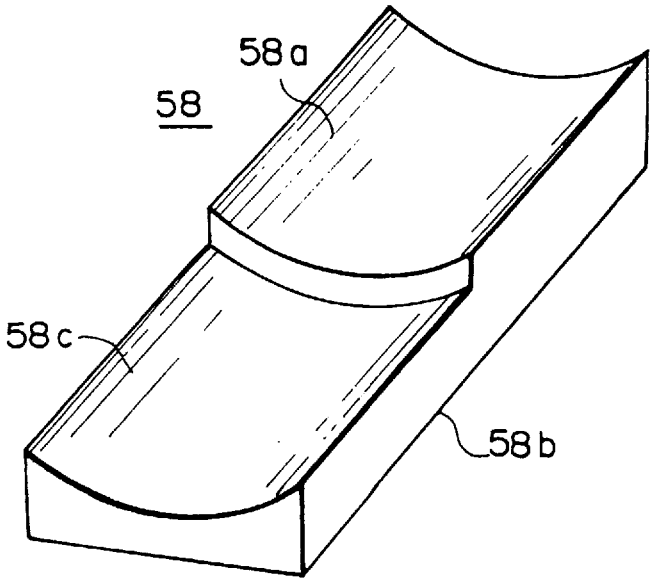
FIG. 29 is a perspective view of the heat accumulator member shown in FIG. 27.

The heat accumulator member 58 is formed by die casting of metal as in the eleventh embodiment as shown in FIG. 29. The heat accumulator member 58 is flat in its lower surface 58*b*. The upper surface of the heat accumulator member 58 is divided in the longitudinal direction into front and rear portions. The rear portion forms a contact surface 58*a* which is arcuated to conform to the outer peripheral surface of the barrel 9*a* of the cassette 9 and is to be in contact with the barrel 9*a*. The front portion forms a recessed portion 58*c* which is disposed away from both the cassette 9 and the heat transfer plate 59 to be described later.

Figure 30:
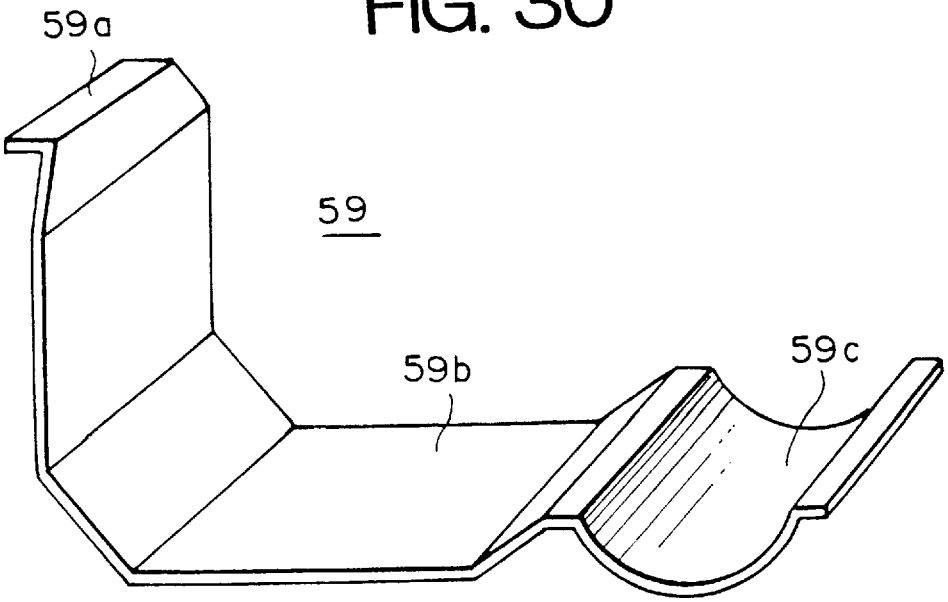
FIG. 30 is a perspective view of the heat transfer plate shown in FIG. 27.

As shown in FIG. 30, the heat transfer plate 59 has a heat receiving portion 59*a* at its one end as in the eleventh embodiment. The heat receiving portion 59*a* is fixed to the burner 7 and the other end portion which extends into the cassette receiving portion 4 from the intermediate portion 59*b* forms a heat releasing portion 59*c*. The heat releasing portion 59*c* is arcuated to conform to the outer peripheral surface of the barrel 9*a* of the cassette 9 and is to be in contact with the barrel 9*a*. The heat releasing portion 59*c* is disposed opposed to the recessed portion 58*c* of the heat accumulator member 58 but away therefrom.

In the vaporization acceleration device of this embodiment, when the cassette 9 is set, the cassette 9 is brought into contact with both the heat accumulator member 58 and the heat transfer plate 59 and is directly supplied with heat from the both. In the early stages of burning, heat is quickly supplied to the cassette 9 from the heat accumulator member 58 through the contact surface 58*a* to suppress temperature drop of the cassette 9. Since the heat accumulator member 58 is high in thermal conductivity, heat is supplied even from portions of the heat accumulator member 58 not in contact with the cassette 9 by virtue of movement of heat.

Further after ignition, the heat receiving portion 59*a* of the heat transfer plate 59 is heated by heat of combustion at the burner 7 and directly supplies heat to the cassette 9 in contact with the heat releasing portion 59*c*. Since the heat releasing portion 59*c* of the heat transfer plate 59 is not in contact with the heat accumulator member 58, the heat transferred from the burner can be suppressed from being dissipated to the air through the heat accumulator member 58 and can be effectively used to heat the cassette 9. The vaporization acceleration effect of this embodiment for continuous burning at the burner 7 in the normal environment of use is equivalent to that of the eleventh embodiment.

[Thirteenth embodiment]

Figure 31:
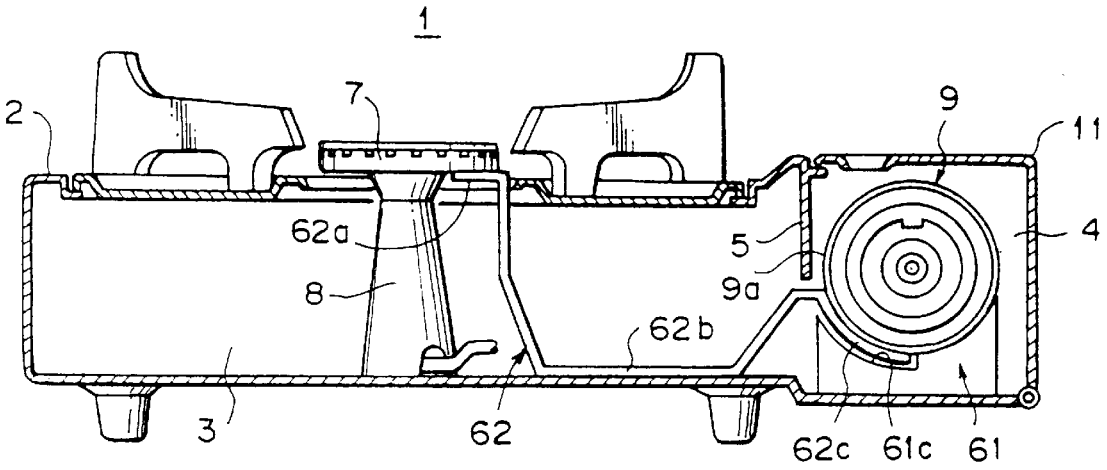
FIG. 31 is a schematic cross-sectional view of a gas appliance provided with a vaporization acceleration device in accordance with a thirteenth embodiment of the present invention.
Figure 32:
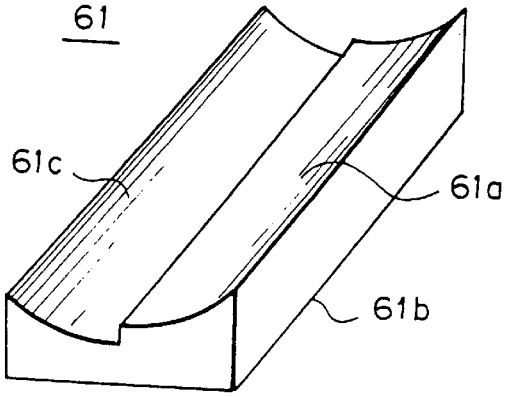
FIG. 32 is a perspective view of the heat accumulator member shown in FIG. 31.
Figure 33:
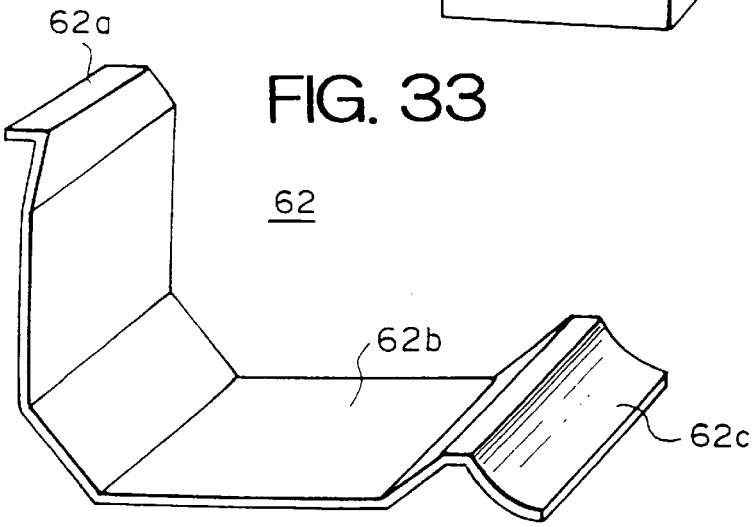
FIG. 33 is a perspective view of the heat transfer plate shown in FIG. 31.

The vaporization acceleration device of this embodiment is shown in FIGS. 31 to 33 and in this embodiment, an end portion of the heat transfer plate is directly brought into contact with the cassette 9.

The heat accumulator member 61 is formed by die casting of metal as in the eleventh embodiment as shown in FIG. 32. The heat accumulator member 61 is flat in its lower surface 61*b*. The upper surface of the heat accumulator member 61 is divided in the transverse direction into left and right portions. The right portion forms a contact surface 61*a* which is arcuated to conform to the outer peripheral surface of the barrel 9*a* of the cassette 9 and is to be in contact with the barrel 9*a*. The left portion forms a recessed portion 61*c* which is disposed away from both the cassette 9 and the heat transfer plate 62 to be described later.

As shown in FIG. 33, the heat transfer plate 62 has a heat receiving portion 62*a* at its one end as in the eleventh embodiment. The heat receiving portion 62*a* is fixed to the burner 7 and the other end portion which extends into the cassette receiving portion 4 from the intermediate portion 62*b* forms a heat releasing portion 62*c*. The heat releasing portion 62*c* is arcuated to conform to the outer peripheral surface of the barrel 9*a* of the cassette 9. The heat releasing portion 62*c* is small in width and extends only to the middle of the cassette 9 though large in length so that the heat releasing portion 59*c* contacts with the cassette 9 over an area substantially the same as that of the heat releasing portion 59*c* in the twelfth embodiment. The heat releasing portion 62*c* is disposed opposed to the recessed portion 61*c* of the heat accumulator member 61 but away therefrom.

In the vaporization acceleration device of this embodiment, when the cassette 9 is set, the cassette 9 is brought into contact with both the heat accumulator member 61 and the heat transfer plate 62 and is directly supplied with heat from the both. In the early stages of burning, heat is quickly supplied to the cassette 9 from the heat accumulator member 61 through the contact surface 61*a* to suppress temperature drop of the cassette 9. Since the heat accumulator member 61 is high in thermal conductivity, heat is supplied even from portions of the heat accumulator member 61 not in contact with the cassette 9 by virtue of movement of heat.

Further after ignition, the heat receiving portion 62*a* of the heat transfer plate 62 is heated by heat of combustion at the burner 7 and directly supplies heat to the cassette 9 in contact with the heat releasing portion 62*c*. Since the heat releasing portion 62*c* of the heat transfer plate 62 is not in contact with the heat accumulator member 61, the heat transferred from the burner can be suppressed from being dissipated to the air through the heat accumulator member 61 and can be effectively used to heat the cassette 9. The vaporization acceleration effect of this embodiment for continuous burning at the burner 7 in the normal environment of use is equivalent to that of the twelfth embodiment.

[Fourteenth embodiment]

Figure 34:
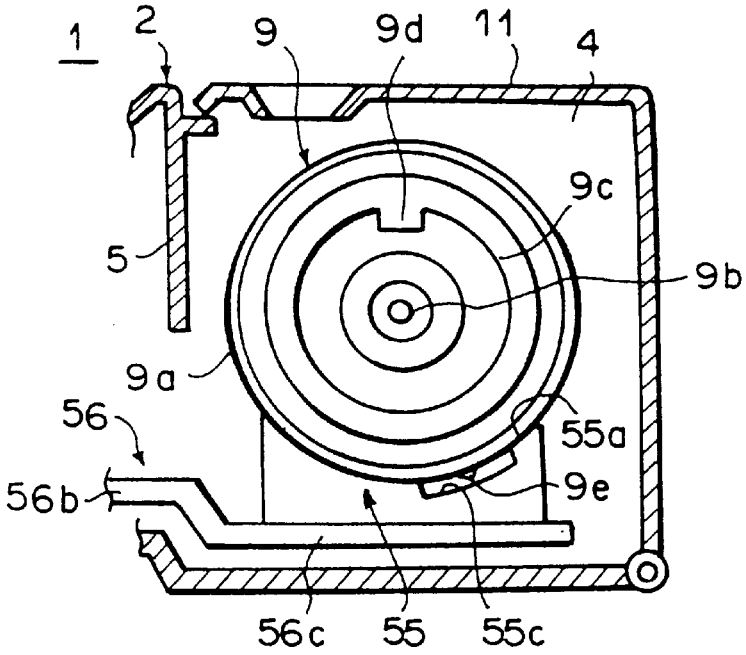
FIG. 34 is a fragmentary schematic cross-sectional view showing an important part of a gas appliance provided with a vaporization acceleration device in accordance with a fourteenth embodiment of the present invention.
Figure 35:
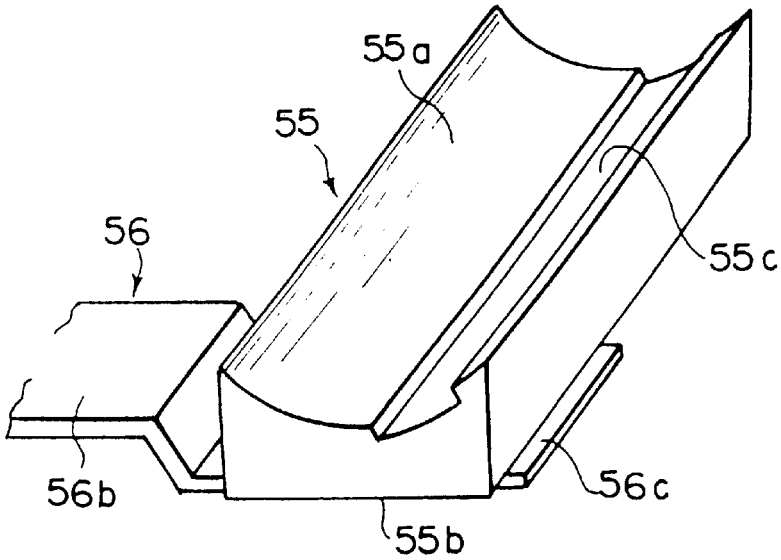
FIG. 35 is a perspective view of the heat accumulator member shown in FIG. 34.

FIG. 34 shows in cross-section an important part of the cassette receiving portion of a gas appliance provided with a vaporization acceleration device in accordance with a fourteenth embodiment of the present invention, and FIG. 35 is a perspective view of the heat accumulator member.

The heat accumulator member 55 and the heat transfer plate 56 are basically the same as those in the eleventh embodiment. However, in this embodiment, the heat accumulator member 55 is provided with a vertical groove 55*c* in the contact surface 55*a*. The vertical groove 55*c* is opposed to a welded portion 9*e* extending in the longitudinal direction of the barrel 9*a* of the cassette 9.

Though the welded portion 9*e* on the barrel 9*a* of the cassette 9 has no standard on its shape and position, the welded portion 9*e* on the current cassette 9 of each maker is 1.Omm in width and 0.2 mm in height and is positioned in the range of ±10 mm about a position angularly spaced by 17° from the position diametrically opposed to the notch 9*d* on the mounting cup 9*c*. The vertical groove 55*c* is formed in a depth of 0.5 mm and in a width of 20 mm about a position angularly spaced by 17° from the center of contact with the cassette 9.

In this embodiment, since the welded portion 9*e* on the cassette 9 is received in the vertical groove 55*c* on the contact surface 55*a* of the heat accumulator member 55 when the cassette 9 is set on the heat accumulator member 55, the outer surface of the barrel 9*a* of the cassette 9 can be in close contact with the contact surface 55*a* without a space formed about the welded portion 9*e*. In this case, though the contact area of the heat accumulator member 55 is narrower than that in the eleventh embodiment, heat transfer efficiency is improved since there is no space formed about the welded portion 9*e* and better vaporization acceleration effect can be obtained.

[Fifteenth embodiment]

Figure 36:
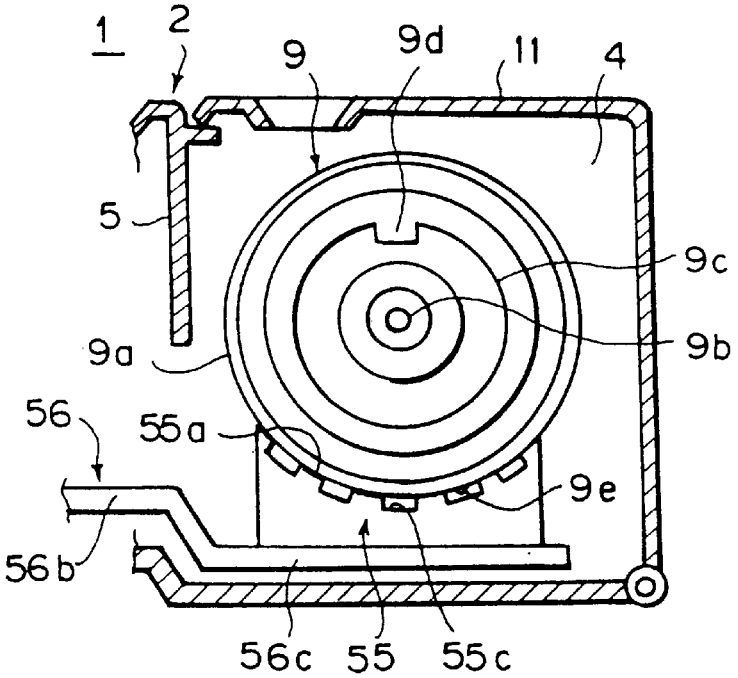
FIG. 36 is a fragmentary schematic cross-sectional view showing an important part of a gas appliance provided with a vaporization acceleration device in accordance with a fifteenth embodiment of the present invention.
Figure 37:
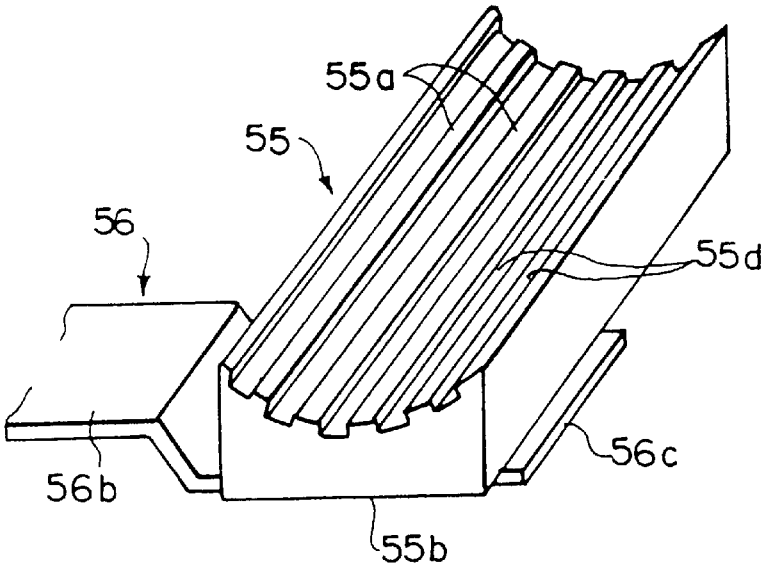
FIG. 37 is a perspective view of the heat accumulator member shown in FIG. 36.

The vaporization acceleration device of this embodiment is shown in FIGS. 36 and 37 and is a modification of the fourteenth embodiment.

The heat accumulator member 55 and the heat transfer plate 56 in this embodiment are basically the same as those of the eleventh embodiment except that a plurality of vertical grooves 55*d* are formed in the contact surface 55*a* of the heat accumulator member 55. The vertical grooves 55*d* are, for instance, 1.5 mm in width and 0.5 mm in depth and are formed at intervals of 3.5 mm.

In this embodiment, when the welded portion 9*e* on the barrel 9*a* of the cassette 9 is deviated from the normal position described above, the welded portion 9*e* can be received in one of the vertical grooves 55*d* so that the contact surface 55*a* of the heat accumulator member 55 can be in close contact with the surface of the barrel 9*a* of the cassette 9 and heat transfer efficiency is increased.

[Sixteenth embodiment]

Figure 38:
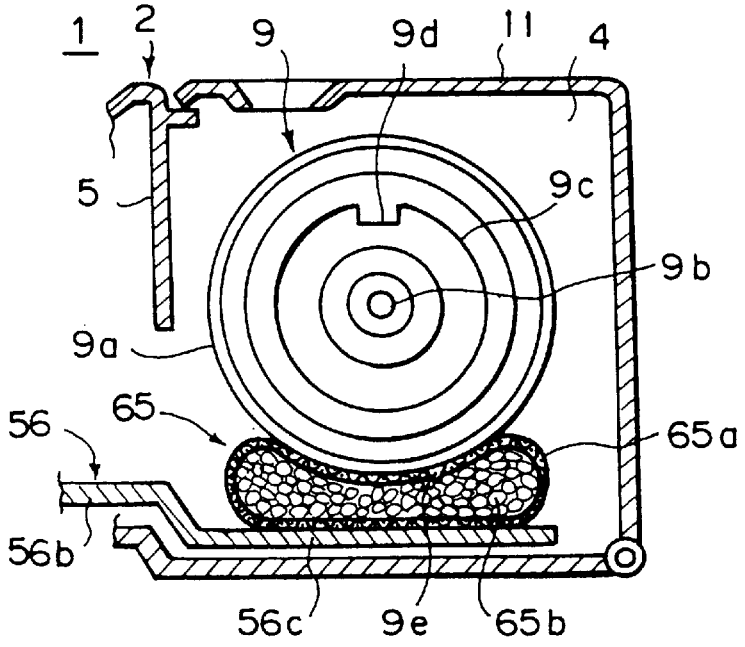
FIG. 38 is a fragmentary schematic cross-sectional view showing an important part of a gas appliance provided with a vaporization acceleration device in accordance with a sixteenth embodiment of the present invention.
Figure 39:
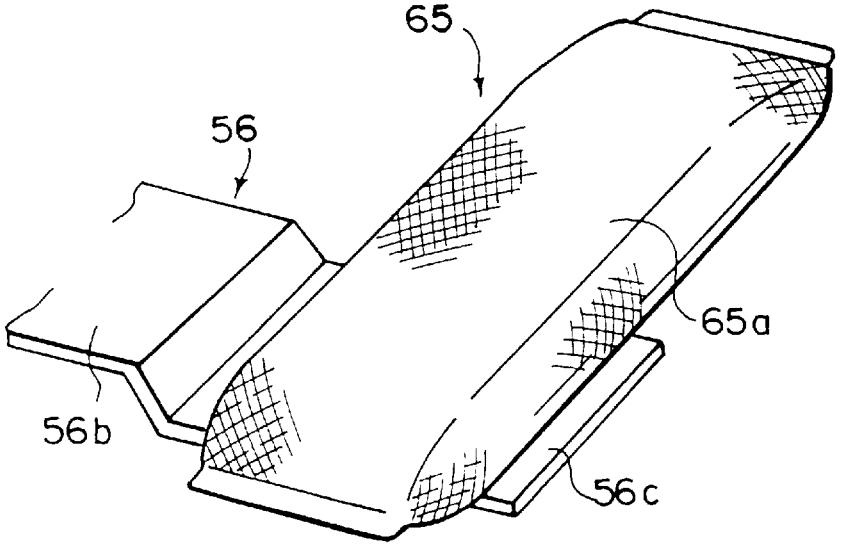
FIG. 39 is a perspective view of the heat accumulator member shown in FIG. 38.

The vaporization acceleration device of this embodiment is shown in FIGS. 38 and 39 and is another embodiment for dealing with the welded portion 9*e* on the cassette 9.

In this embodiment, the heat accumulator member 65 is formed by filling metal particles 65*b* (e.g., granular bronze of 145 to 280 mesh) in a flexible metal container in the form of, for instance, a bag of stainless steel mesh (350 mesh). The heat transfer plate 56 is of the same structure as that of the preceding embodiment.

Specifically the heat accumulator member 65 comprises a bag of stainless steel mesh which is 50 mm in width, 170 mm in length and 10mm in height and 740 g of granular bronze filled in the bag.

In this embodiment, the heat accumulator member 65 is deformable. When the cassette 9 is set on the heat accumulator member 65 is received in a recess formed in the heat accumulator member 65 by deformation of the flexible container 65*a* and movement of the metal particles 65*b*, whereby the heat accumulator member 65 can be in close contact with the cassette barrel 95*a*.

As the flexible container 65*a*, metal foil and the like can be employed in place of metal mesh and metal particles, metal powder or the like may be filled in the container.

[Experiment 4]

Figure 40:
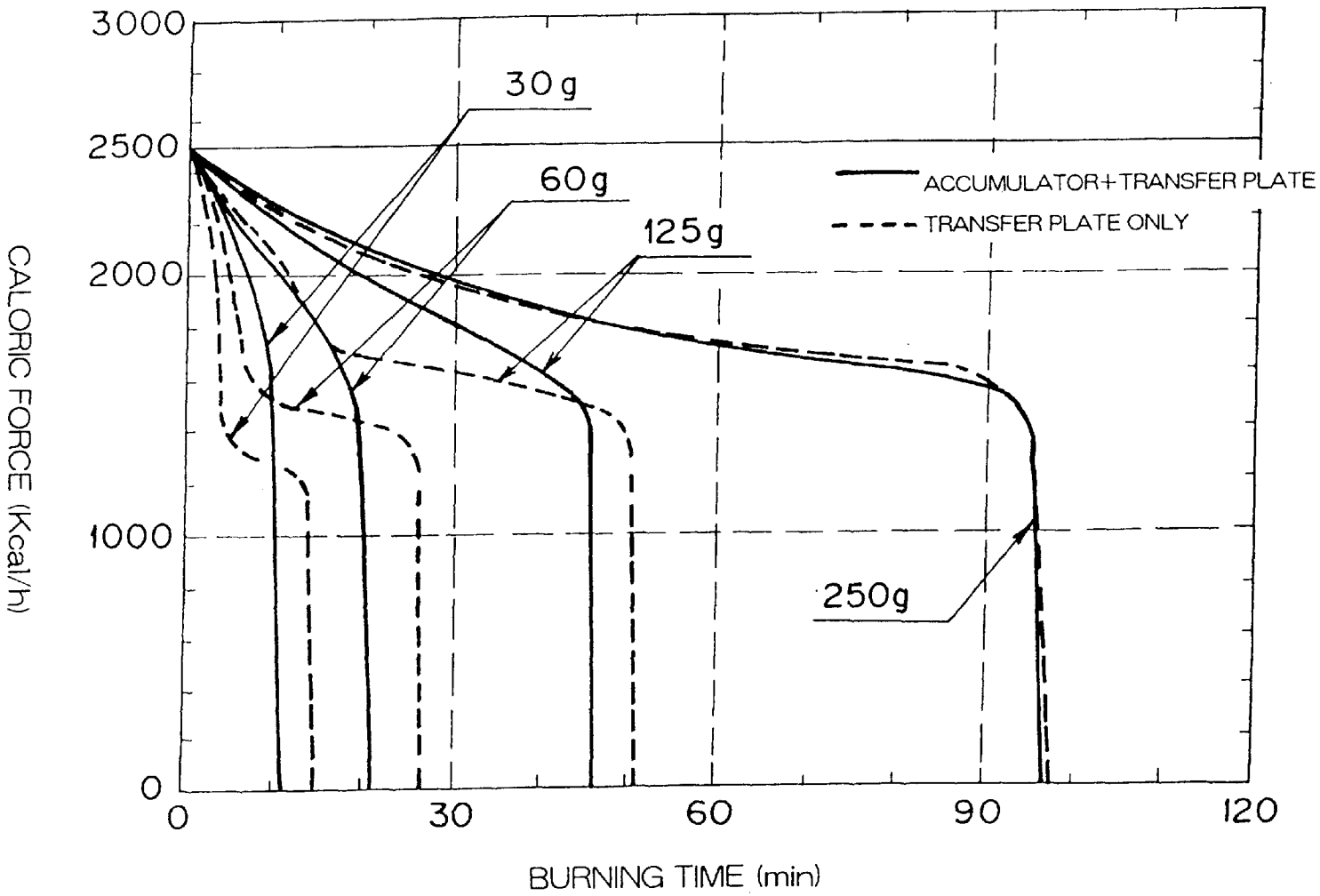
FIG. 40 is a graph showing a result of measurement of change in caloric force versus burning time in a fourth experiment.

Using the gas appliance 1 provided with the heat accumulator member 55 and the heat transfer plate 56 such as shown in the eleventh embodiment, a burning experiment was carried out. In the burning experiment, a plurality of cassettes 9 respectively containing therein 250 g, 125 g, 60 g and 30 g of liquefied butane gas (70% of normal butane and 30% of isobutane) were set to the gas appliance 1 and change in caloric force until the liquefied gas was exhausted and the gas appliance 1 was spontaneously quenched was measured with the caloric force initially set at 2500 kcal/hr (16 to 17° C. in atmospheric temperature). The result of the burning experiment for the respective initial amounts of gas is shown by solid lines in FIG. 40. Dashed lines in FIG. 40 show the result of the similar experiment using a gas appliance provided with a heat transfer plate only. The heat transfer plate used was similar to that in the twelfth embodiment and was provided with an arcuate heat releasing portion in contact with the cassette 9 to heat the same with a part of heat of combustion transferred through the heat transfer plate.

As can be seen from FIG. 40, when only the heat transfer plate was provided, caloric force drop in the early stages of burning was significant for the case where the initial amount of gas was small and the temperature of the cassette rapidly lowered. When a certain time lapsed and heat supply through the heat transfer plate started, the caloric force drop was suppressed. To the contrast, in the case of the gas appliance provided with both the metal heat accumulator member and the heat transfer plate, caloric force drop in the early stages of burning was suppressed by heat supply from the heat accumulator member and high caloric force was maintained, which resulted in a shorter burning time before quenching. When the initial amount of gas was 250 g (full), the effect of the heat accumulator member was less due to that the heat capacity of the liquefied gas was large and temperature drop due to vaporization latent heat was small.

Figure 41:
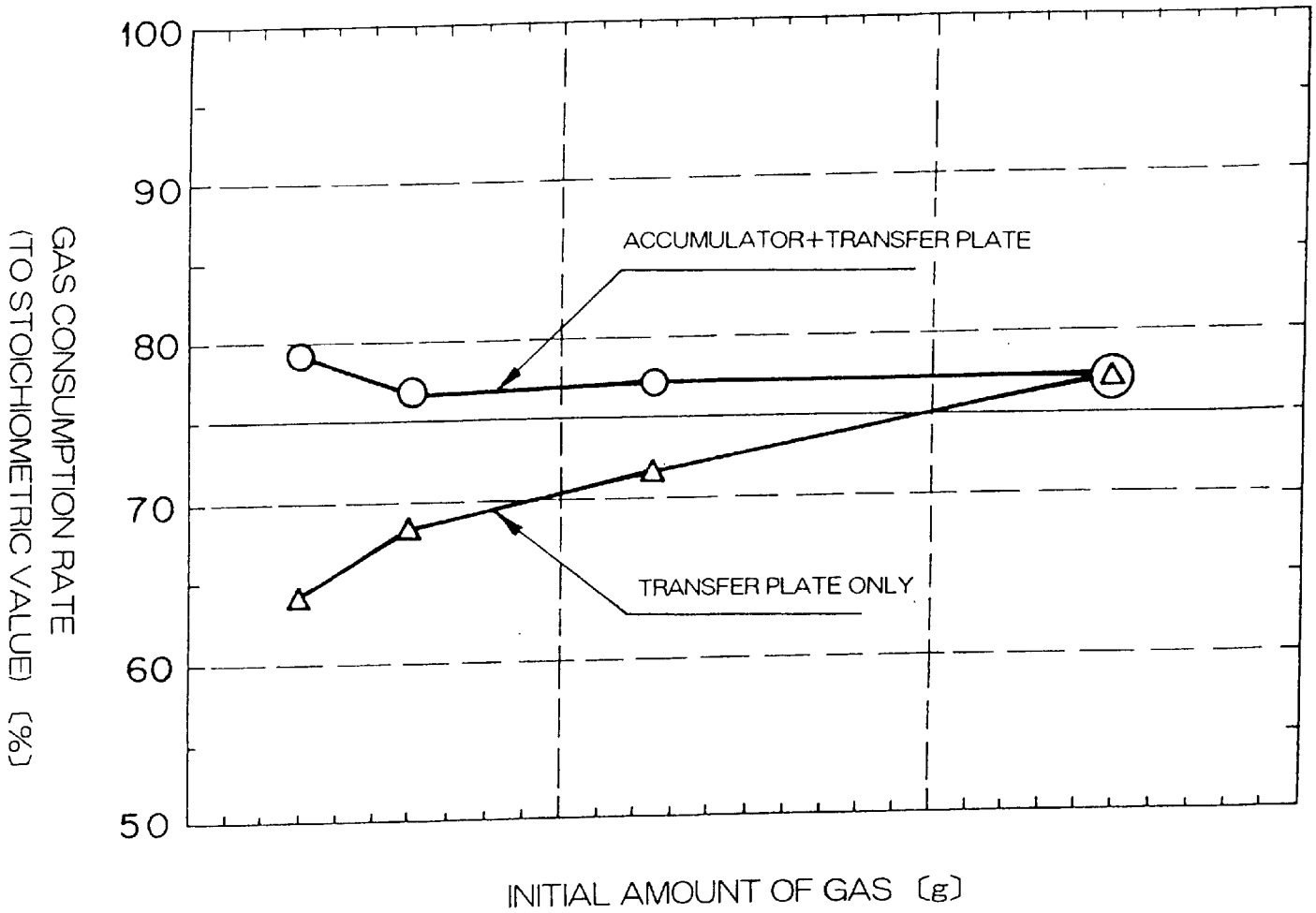
FIG. 41 is a graph showing a result of measurement of relation between gas consumption and the initial amount of gas in the fourth experiment.

In order to check condition of exhaustion of the liquefied gas for each initial amount of gas, gas consumption was measured 83 minutes after ignition for the initial amount of gas of 250 g, 42 minutes after ignition for the initial amount of gas of 125 g, 20 minutes after ignition for the initial amount of gas of 60 g, and 10 minutes after ignition for the initial amount of gas of 30 g. Then the gas consumption ratio, the ratio of the actual gas consumption to a stoichiometric value of gas consumption which should be consumed when the caloric force of 2500 kcal/hr was optimally maintained was obtained and reported in FIG. 41.

Since the measured consumption ratio was against the stoichiometric value, any one of the measured values did not reach 100%. However when the measured consumption ratio was not lower than 75%, practically it may be considered that the gas was exhausted. On the other hand, when the measured consumption ratio was lower than 75%, it should be considered that caloric force lowered and the liquefied gas was quenched before exhausted and a certain amount of liquefied gas remained in the cassette. In this regard, as can be seen from FIG. 41, in the case where the heat transfer plate only was provided, the consumption ratio was lower than 75% for the initial amounts of gas of not larger than 190 g, which indicates that the gas was not exhausted. To the contrast, in the case of the present invention where both the heat accumulator member and the heat transfer plate were provided, gas consumption ratio was never lower than 75%, which indicates that the gas was exhausted irrespective of the initial amount of gas.

[Experiment 5]

Figure 42:
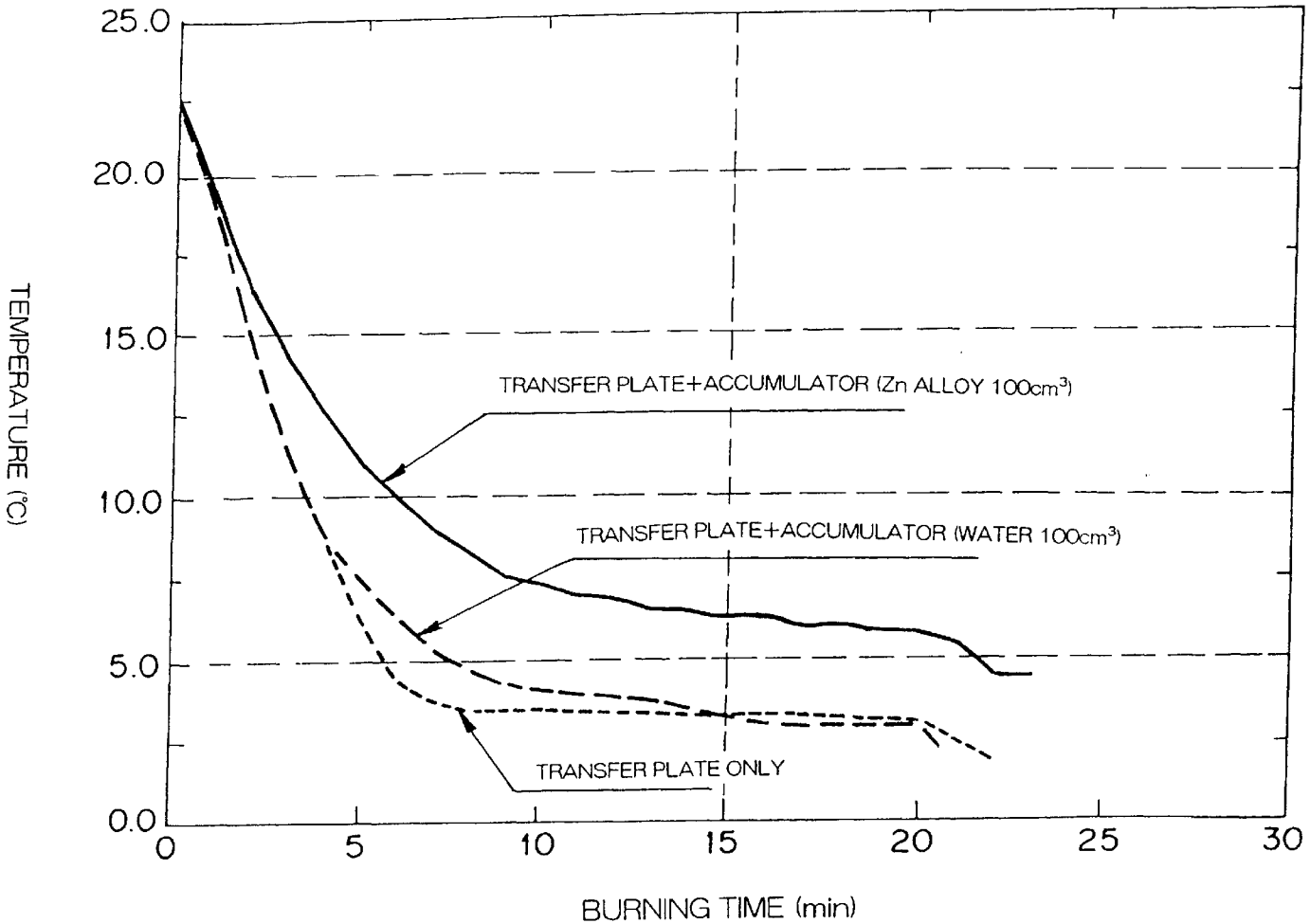
FIG. 42 is a graph showing a result of measurement of change in temperature of the cassette versus burning time in a fifth experiment.

Using the gas appliance 1 provided with a vaporization acceleration device comprising the heat accumulator member and the heat transfer plate such as shown in the eleventh embodiment, a burning experiment was carried out. In the burning experiment, a cassette 9 containing therein 60 g of liquefied gas was set to the gas appliance 1 and change in temperature with time of the bottom of the barrel 9*a* of the cassette 9 was measured with the caloric force initially set at 2500 kcal/hr (22° C. in atmospheric temperature). The result is shown in FIG. 42. FIG. 42 also includes the result of similar experiments using a vaporization acceleration device comprising the heat transfer plate only (first comparison), and a vaporization acceleration device comprising the heat transfer plate and a heat accumulator member of 0.2 mm thick vinyl chloride bag filled with water (attached to the lower surface of the heat transfer plate at the contact portion thereof with the cassette) (second comparison).

As can be seen from FIG. 42, in the case where only the heat transfer plate was provided, the temperature of the cassette was rapidly lowered in response to vaporization of liquefied gas by high-calorie burning in the early stages of burning because of no heat supply and small heat capacity of liquefied gas which was only 60 g. Though heat supply from the heat transfer plate increased from the time 6 to 7 minutes after ignition and equilibrium attained, the temperature under this equilibrium state was low and the caloric force became lower.

In the case where water was used as the heat accumulator material, though heat was supplied from the heat accumulator member before initiation of heat supply from the heat transfer plate, the heat supply from the heat accumulator member was only heat from the surface layer thereof and was not sufficient.

To the contrast, in the case of the present invention, since the heat accumulator member was of metal, heat was rapidly supplied to the cassette according to the difference between the heat accumulator member and the cassette in response to temperature drop of the cassette from the initiation of burning to slow down the temperature drop of the cassette whereby caloric force of burning was kept high and the quantity of heat supplied through the heat transfer plate was large to reduce the temperature drop of the cassette, thereby keeping high the temperature of the cassette.

For example, when the gas appliance is caused to burn at 2500 kcal/hr, the vaporization latent heat of the liquefied gas in the cassette is 300 cal/minute. When the quantity of heat is supplied from the exterior, burning at the caloric force can be maintained. However it is practically impossible to sufficiently supply the required quantity of heat by the heat accumulator member and the heat transfer plate, and accordingly the temperature of the cassette and the liquefied gas therein lowers and the equilibrium gas pressure also lowers.

However in view of the equilibrium gas pressure, burning at 2500 kcal/hr can be maintained until the temperature of the liquefied gas in the cassette lowers to 5° C. Thus, in order to maintain burning at the high caloric force, it is necessary to make the time the temperature of the cassette takes to lower to 5° C. as long as possible by heat supply from the heat accumulator member and the heat transfer plate.

Figure 43:
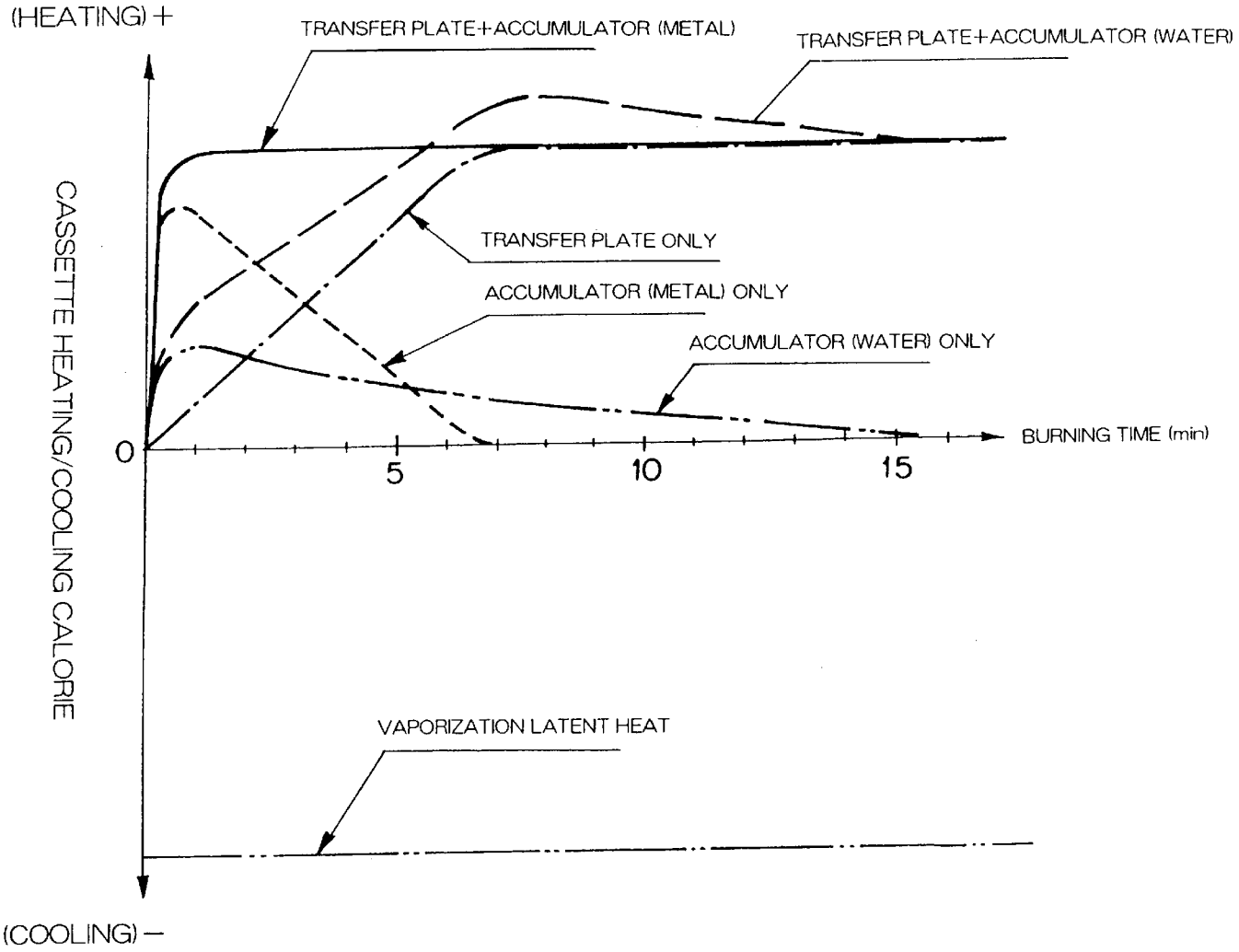
FIG. 43 is a graph showing a result of measurement of heat supply by the heat accumulator member or the heat transfer plate in the fifth experiment.
Figure 44:
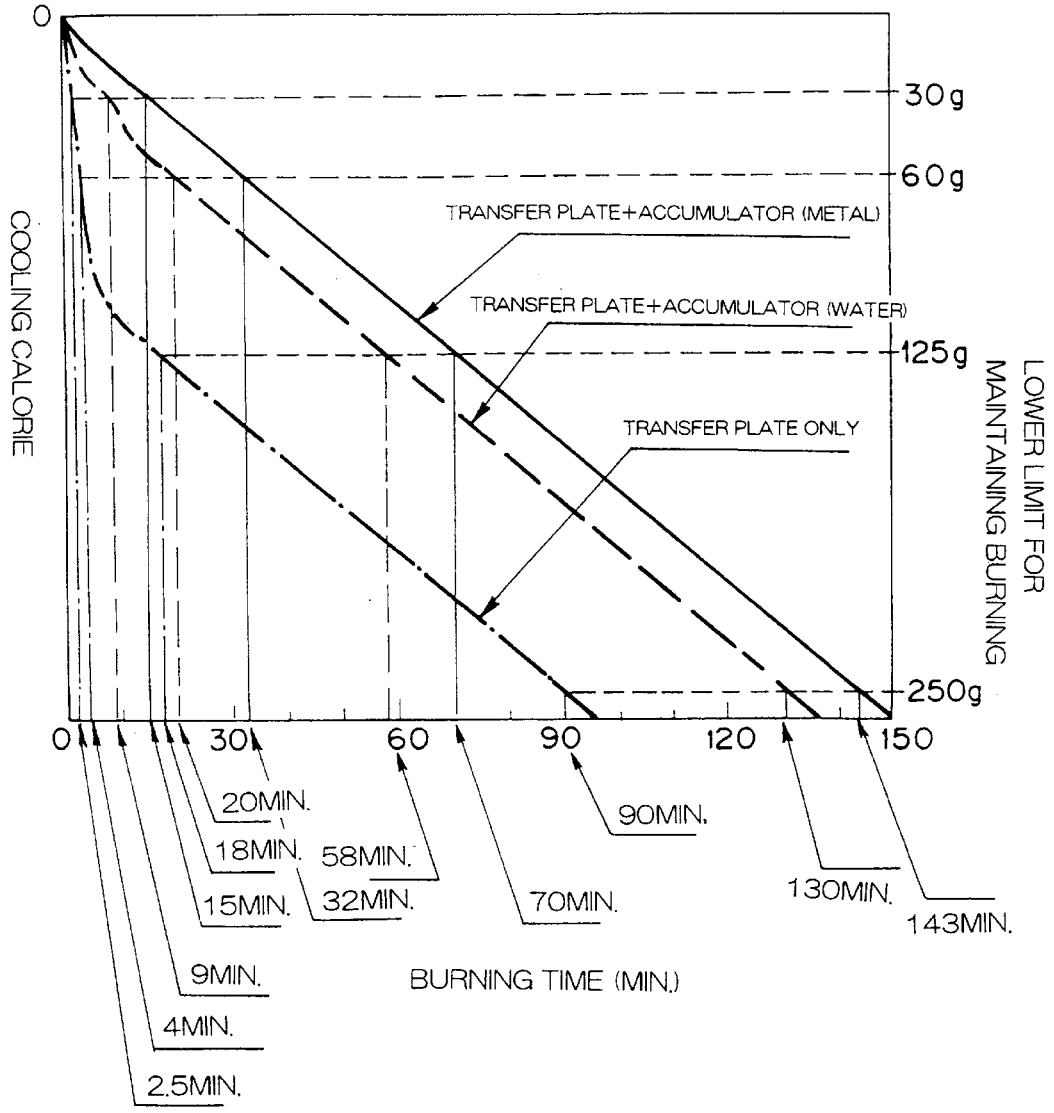
FIG. 44 is a graph showing a result of measurement of relation between the total cooling calorie and burning maintaining properties versus burning time in the fifth experiment.
Figure 45:
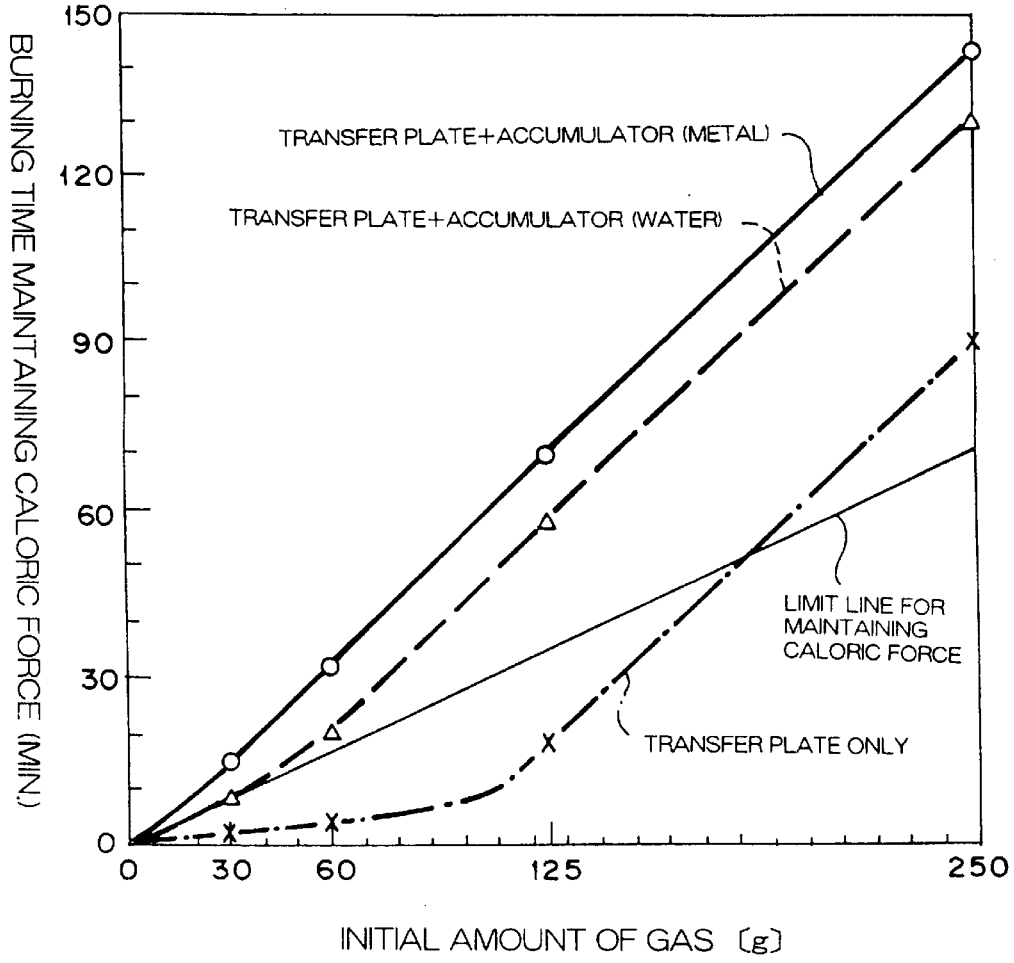
FIG. 45 is a graph showing a result of measurement of relation between the initial amount of gas and burning time for which a predetermined caloric force is maintained.

FIG. 43 shows the change in the quantities of heat supplied to the cassette respectively from the metal heat accumulator member, the heat accumulator member using water and the heat transfer plate in the above experiment, FIG. 44 shows the change in cooling calorie of the cassette, i.e., the values obtained by subtracting the quantities of heat supplied to the cassette from the vaporization latent heat, and FIG. 45 shows the time for which caloric force of the high-calorie burning was maintained for the initial amounts of gas described above. FIG. 45 also shows the time for which burning was continued as a limit line for maintaining caloric force.

As shown in FIG. 43, in the case of the heat transfer plate only, the quantity of heat supplied was gradually increased from initiation of burning and attained equilibrium 6 to 7 minutes after. In the process of attaining equilibrium, the temperature of the liquefied gas lowered until heat supply from the heat transfer plate increased and accordingly gas supply to the burner was reduced to reduce the caloric force of burning, whereby heat supply from the heat transfer plate was also reduced and reduced heat supply and the vaporization latent heat attained equilibrium at a low level.

As described above, the liquefied gas in the cassette has a heat capacity which depends upon the amount of liquefied gas in the cassette. Accordingly as the amount of gas remaining in the cassette reduces, the heat capacity of the liquefied gas is reduced and cooling rate by the vaporization latent heat becomes more rapid. That is, as shown in FIG. 44, in the case of the heat transfer plate only, the time for which caloric force of 2500 kacl/hr was maintained was 4 minutes for the initial amount of gas of 60 g, 18 minutes for 125 g and 90 minutes for 250 g.

Further in the case of the heat transfer plate only, though there is no problem when the initial amount of gas is 250 g since the burning time was not lower than the limit line for maintaining caloric force as shown in FIG. 45. However when the initial amount of gas is 125 g, 60 g or 30 g, the burning time was lower than the limit line for maintaining caloric force and accordingly it should be considered that high-calorie burning could not be maintained due to temperature drop though there remained a certain amount of liquefied gas in the cassette and the cassette could not be exhausted of liquefied gas.

To the contrast, in the case of the heat accumulator member of metal or water only, heat supply to the cassette was initiated in response to temperature drop of the cassette due to ignition and the quantity of heat supplied to the cassette shown in FIG. 43 was gradually reduced. In the case of the heat accumulator member of metal, this response was quicker than the case of heat accumulator member of water, where transfer of accumulated heat was slow. That is, in the case of the heat accumulator member of water, heat supply per unit time is small but continues long, whereas in the case of the heat accumulator member of metal, though heat supply per unit time is large, it continues only for a short time.

To the contrast, in the case of combination of the heat accumulator member of metal or water and the heat transfer plate, the quantity of heat supplied to the cassette is the sum of those by the heat accumulator member and the heat transfer plate. In the case of the invention shown by the solid line, the quantity of heat supplied was large and stable from the beginning of burning whereas in the case of the comparison using the combination of the heat transfer plate and the heat accumulator member of water, the quantity of heat supplied was small in the early stages of burning though the peak value was high.

Further as can be seen from FIG. 44, when both the heat accumulator member and the heat transfer plate are provided, temperature drop just after initiation of burning can be suppressed and the continuous burning maintaining time can be increased. Further temperature drop of the cassette before equilibrium attains can be reduced, whereby caloric force of burning is increased and equilibrium at a high level can be obtained. Especially in the case of the invention (solid line) where the quantity of heat supplied in the early stages of burning is large, better properties can be obtained.

As a result, the caloric force maintaining time in FIG. 45 becomes higher than the limit line for maintaining caloric force, and even if the initial amount of gas is small, the cassette can be exhausted of liquefied gas maintaining high-calorie burning.

What is claimed is:

1. A vaporization acceleration device for a high-calorie gas appliance which is set with a replaceable fuel gas cassette containing therein liquefied gas and has a burner for burning vaporized fuel gas from the cassette, which vaporization acceleration device comprising:

a heat transfer plate which is mounted on the gas appliance with its one end portion disposed near the burner and its the other end portion in contact with the fuel gas cassette so that a part of heat of combustion at the burner is transferred to the fuel gas cassette to heat the same, and a heat accumulator member which is disposed in contact with the heat transfer plate in the position of contact of the heat transfer plate with the cassette.

2. A vaporization acceleration device for a high-calorie gas appliance as defined in claim 1 in which the heat accumulator member is in contact with the heat transfer plate in the position of contact of the heat transfer plate with the cassette and at the same time is adapted to be brought into contact with a part of the cassette.

3. A vaporization acceleration device for a high-calorie gas appliance as defined in claim 1 or 2 in which the heat accumulator member comprises a liquid heat accumulator material contained in a casing.

4. A vaporization acceleration device for a high-calorie gas appliance as defined in claim 3 in which the liquid heat accumulator material is a latent heat accumulator material which is 4 to 14° in fusion point and latent heat of fusion of the material is utilized.

5. A vaporization acceleration device for a high-calorie gas appliance as defined in claim 4 in which the liquid heat accumulator material comprises polyethylene glycols of different molar weights which are mixed to adjust the fusion point.

6. A vaporization acceleration device for a high-calorie gas appliance as defined in claim 3 in which the liquid heat accumulator material is water and sensible heat of water is utilized.

7. A vaporization acceleration device for a high-calorie gas appliance as defined in claim 1 or 2 in which the heat accumulator member comprises a solid heat accumulator material.

8. A vaporization acceleration device for a high-calorie gas appliance as defined in claim 1 or 2 in which a heat conductive member is provided in the position of contact of the heat transfer plate with the heat accumulator member in contact with a part of the heat accumulator member other than the part in contact with the heat transfer plate with an end portion of the heat conductive member in contact with the heat transfer plate.

9. A vaporization acceleration device for a high-calorie gas appliance which is set with a replaceable fuel gas cassette containing therein liquefied gas and has a burner for burning vaporized fuel gas from the cassette, which vaporization acceleration device comprising a heat transfer plate which is mounted on the gas appliance with its one end portion disposed near the burner and its the other end portion in contact with the fuel gas cassette so that a part of heat of combustion at the burner is transferred to the fuel gas cassette to heat the same, and a heat exchanger member which exchanges heat with the air and is disposed in contact with the heat transfer plate in the position of contact of the heat transfer plate with the cassette.

10. A vaporization acceleration device for a high-calorie gas appliance as defined in claim 9 in which the heat exchanger member is disposed in contact with the heat transfer plate in the position of contact of the heat transfer plate with the cassette and at the same time is able to be brought into contact with a part of the cassette.

11. A vaporization acceleration device for a high-calorie gas appliance as defined in claim 9 in which the heat exchanger member is a member which is formed by folding a metal plate or a metal foil and fixed to the heat transfer plate on the side opposite to the side which the cassette is in contact with.

12. A vaporization acceleration device for a high-calorie gas appliance as defined in claim 9 in which the heat exchanger member is of a honeycomb sandwich structure.

13. A vaporization acceleration device for a high-calorie gas appliance as defined in claim 9 in which the heat exchanger member is a member having fin-like projections.

14. A vaporization acceleration device for high calorie gas appliance which is set with a replaceable fuel gas cassette containing therein liquefied gas and has a burner for burning vaporized fuel gas from the cassette comprising:

a heat exchanger member which exchanges heat with the air and is disposed in heat transfer relation to the cassette, and a heat transfer plate which is mounted on the gas appliance with its one end portion disposed near the burner and its the other end portion disposed in heat transfer relation to the cassette and also to the heat exchanger member so that a part of heat of combustion at the burner is transferred to the heat exchange member.

15. A vaporization acceleration device for a high calorie gas appliance which is set with a replaceable fuel gas cassette containing therein liquefied gas and has a burner for burning vaporized fuel gas from the cassette comprising:

a heat accumulator member of metal a part of which is in contact with the cassette so that heat is supplied to the cassette from the heat accumulator member in early stages of combustion, and a heat transfer plate which is disposed with its one end portion disposed near the burner and its the other end portion extending along a surface of the heat accumulator member in spaced relation to a surface of the cassette so that a part of heat of combustion at the burner is transferred to the heat accumulator member.

16. A vaporization acceleration device for a high-calorie gas appliance which is set with a replaceable fuel gas cassette containing therein liquefied gas and has a burner for burning vaporized fuel gas from the cassette, which vaporization acceleration device comprising a heat accumulator member of metal a part of which is in contact with the cassette so that heat is supplied to the cassette from the heat accumulator member in early stages of combustion, and a heat transfer plate which is disposed with its one end portion disposed near the burner and its the other end portion not in contact with the heat accumulator member and in contact with the cassette at a portion not in contact with the heat accumulator member so that a part of heat of combustion at the burner is transferred to the cassette.

17. A vaporization acceleration device for a high-calorie gas appliance as defined in claim 15 or 16 in which the surface of the heat accumulator member to be in contact with the cassette is formed into an arcuate surface conforming to the surface of the barrel of the cassette and a vertical groove is formed in the arcuate surface.

18. A vaporization acceleration device for a high-calorie gas appliance as defined in claim 15 or 16 in which the heat accumulator member is formed of a flexible container and metal particles or metal powder contained in the container.

* * * * *